United States Patent [19]

Kobayashi et al.

[11] Patent Number: 5,017,466

[45] Date of Patent: May 21, 1991

[54] COLOR-FORMING AMINOPYRIMIDINE COUPLERS AND SILVER HALIDE COLOR PHOTOGRAPHIC LIGHT-SENSITIVE MATERIALS CONTAINING THE COUPLER

[75] Inventors: Hidetoshi Kobayashi; Reiichi Ohi; Kei Sakanoue, all of Kanagawa, Japan

[73] Assignee: Fuji Photo Film Co., Ltd., Kanagawa, Japan

[21] Appl. No.: 527,376

[22] Filed: May 23, 1990

[30] Foreign Application Priority Data

May 24, 1989 [JP] Japan ..... 1-130985

[51] Int. Cl.[5] ..... G03C 7/38

[52] U.S. Cl. ..... 430/558; 430/376; 430/387; 430/558

[58] Field of Search ..... 430/558 R, 558 A

[56] References Cited

U.S. PATENT DOCUMENTS

| | | | |
|---|---|---|---|
| 2,718,466 | 9/1955 | Wolfson | 430/558 |
| 3,635,721 | 1/1972 | Sato et al. | 96/126 |
| 4,921,783 | 5/1990 | Nakayama et al. | 430/558 |

FOREIGN PATENT DOCUMENTS

| | | |
|---|---|---|
| 0249453 | 12/1987 | European Pat. Off. . |
| 1047612 | 11/1966 | United Kingdom . |
| 1252418 | 11/1968 | United Kingdom . |
| 1334515 | 10/1973 | United Kingdom . |

*Primary Examiner*—Richard L. Schilling

*Attorney, Agent, or Firm*—Birch, Stewart, Kolasch & Birch

[57] ABSTRACT

A color-forming aminopyrimidine coupler represented by formula (I):

(I)

where $R_1$, $R_2$, and $R_3$ independently represent a hydrogen atom, a halogen atom, an alkoxy group, an aryloxy group, a heterocyclic-oxy group, an alkylthio group, an arylthio group, a heterocyclic-thio group, a substituted or unsubstitued amino group, a heterocyclic group bonding to the pyrimidine ring via a nitrogen atom thereof, an alkyl group or an aryl group; provided that at least one of $R_1$, $R_2$ and $R_3$ is an unsubstituted or substituted amino group, and that when any one of $R_1$, $R_2$ or $R_3$ contains a sulfonic acid group or a salt thereof, $R_1$, $R_2$ or $R_3$ contains at least one linear or branched alkyl group and that the total carbon atoms in the alkyl group(s) are to be more than 8; and $R_4$ represents a hydrogen atom, a halogen atom, an alkoxy group, an aryloxy group, a heterocyclic-oxy group, an alkylthio group, an arylthio group, a heterocyclic-thio group, a substituted or unsubstituted amino group, or a heterocyclic group bonding to the pyrimidine ring via a nitrogen atom thereof.

At least one coupler of formula (I) is incorporated into the photographic constitutive layer of a color silver halide photographic material, which gives a color image with high heat-fastness.

16 Claims, No Drawings

COLOR-FORMING AMINOPYRIMIDINE COUPLERS AND SILVER HALIDE COLOR PHOTOGRAPHIC LIGHT-SENSITIVE MATERIALS CONTAINING THE COUPLER

FIELD OF THE INVENTION

The present invention relates to new yellow to cyan color-forming aminopyrimidine couplers and to silver halide color photographic light-sensitive materials containing the same.

BACKGROUND OF THE INVENTION

Dye forming couplers are developed as intermediates of information recording materials such as silver halide photographic light-sensitive materials, color forming reagent compositions, filters, paints and inks or dyes for printing. Especially, in the field of silver halide photographic light-sensitive material, it is well known that an aromatic primary amine color developing agent when oxidized with an oxidizing agent of an exposed silver halide reacts with a coupler to give indophenol, indaniline, indamine, azomethine, phenoxazine, phenazine or a like dye, to thereby form a color image. In such a photographic system, a subtractive color photographic process is employed, where color images are formed with yellow, magenta and cyan dyes.

For forming yellow color images, acylacetanilide or benzoylacetanilide couplers are employed. For forming magenta color images, 5-pyrazolone, cyanoacetophenone, imidazolone, pyrazolobenzimidazole or pyrazolotriazole couplers are employed. For forming cyan color images, phenol or naphthol couplers are employed.

Almost all the magenta couplers which have hitherto been studied are 5-pyrazolone compounds. However, as the dyes to be derived from the couplers have some unfavorable absorption in the vicinity of 430 nm, they extremely lower the color reproducibility of the couplers.

In order to overcome this problem, pyrazolobenzimidazole skeletons disclosed in British Patent 1,047,612, indazolone skeletons disclosed in U.S. Pat. No. 3,770,447, and pyrazolotriazole skeletons disclosed in U.S. Pat. No. 3,725,067 and British Patents 1,252,418 and 1,334,515, have been proposed. Among them, the dyes to be derived from the pyrazolotriazole couplers are almost free from the unfavorable absorption in the vicinity of 430 nml, and therefore, they are favorable to the color reproducibility.

However, these couplers have other problems. For example the process of producing the couplers requires many reaction steps or the yield of the couplers by the process is poor. Additionally, they have further problems in that the coupling reaction activity in the reaction between the couplers and developing agents is low and the dyes formed from the couplers by the coupling reaction have a poor light-fastness.

On the other hand, the phenol or naphthol couplers which have heretofore been employed as the cyan coupler give dyes which have some unfavorable absorption in the region of a green color and therefore have a problem that the couplers extremely lower the color reproducibility.

In order to overcome the problem, 2,4-diphenylimidazole couplers described in European Patent 249,453 has been proposed. The dyes formed from the couplers are almost free from the unfavorable absorption in the region of a green color and therefore are favorable to the color reproducibility of the couplers.

However, the couplers have some problems that the coupling activity thereof is low and the dyes formed therefrom have an extremely poor fastness to heat and light.

SUMMARY OF THE INVENTION

Accordingly, the first object of the present invention is to provide new yellow to cyan color-forming couplers and silver halide color photographic materials containing the same.

The second object of the present invention is to provide new yellow to cyan color-forming couplers which can be produced with ease and to provide silver halide color photographic materials containing such couplers.

The third object of the present invention is to provide new yellow to cyan color-forming couplers which give dyes having an excellent fastness, especially an excellent fastness to heat, and to provide silver halide color photographic materials containing such couplers.

These objects have been attained by a coupler represented by a general formula (I), or a silver halide color photographic light-sensitive material having a photographic layer constitution composed of at least one silver halide emulsion layer on a support, in which at least one layer of the said photographic layer constitution contains at least one of color-forming aminopyrimidine couplers of a general formula (I):

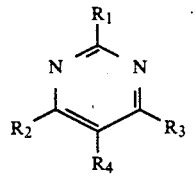

(I)

where, $R_1$, $R_2$, and $R_3$ independently represent a hydrogen atom, a halogen atom, an alkoxy group, an aryloxy group, a heterocyclic-oxy group, an alkylthio group, an arylthio group, a heterocyclic-thio group, a substituted or unsubstituted amino group, a heterocyclic group bonding to the pyrimidine ring via a nitrogen atom thereof, an alkyl group or an aryl group; provided that at least one of $R_1$, $R_2$ and $R_3$ is a monosubstituted or unsubstituted amino group, and that when at least one of $R_1$, $R_2$ and $R_3$ contains a sulfonic acid group or a salt thereof, $R_1$, $R_2$ or $R_3$ must contain at least one linear or branched alkyl group and the total carbon atoms in the alkyl group(s) are to be more than 8; and $R_4$ represents a hydrogen atom, a halogen atom, an alkoxy group, an aryloxy group, a heterocyclic-oxy group, an alkylthio group, an arylthio group, or a heterocyclic-thio group, a substituted or unsubstituted amino group, a heterocyclic group bonding to the pyrimidine ring via a nitrogen atom thereof.

DETAILED DESCRIPTION OF THE INVENTION

The couplers of the formula (I) are explained in detail hereunder.

$R_1$, $R_2$, $R_3$ and $R_4$ in formula (I) each preferably represents a hydrogen atom, a halogen atom (e.g. fluorine, chlorine, bromine, iodine), an alkoxy group having from 1 to 24 carbon atoms, an aryloxy group having from 6 to 24 carbon atoms, a heterocyclic-oxy group having from 1 to 24 carbon atoms, an alkylthio group having from 1 to 24 carbon atoms, an arylthio group having from 6 to 24 carbon atoms, a heterocyclicthio group having from 1 to 24 carbon atoms, and a substituted or unsubstituted amino group having from 0 to 24 carbon atoms, and a heterocyclic group bonding to the pyrimidine ring via the nitrogen atom thereof and having from 1 to 24 carbon atoms. $R_1$, $R_2$ and $R_3$ each further represents an alkyl group having from 1 to 24 carbon atoms, or an aryl group having from 6 to 24 carbon atoms.

In the present invention, in a heterocyclic ring-containing group the heterocyclic ring is preferably a 5- to 7-membered ring (which may be condensed) containing at least one of N, O and S atom as a hetero atom, and examples thereof include a 2-pyridyl, 3-pyridyl, 4-pyridyl, 2-furyl, 2-thienyl, 2-pyrimidyl, 2-benzimidazolyl, 2-benzothiazolyl, 1,3,4-thiazol-2-yl, 2-imidazolyl, pyrrolidinyl, piperidyl, pyrrol-1-yl, imidazol-1-yl, morpholino, 3-pyrazoline-2-yl, 2-thiazolyl, 1-pyrazolyl, 1-imidazolyl, tetrazolyl, oxadiazolyl groups,

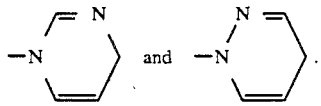

The above-mentioned limitation on the number of the carbon atoms for the respective substituents indicates the preferred range of carbon atoms for the same. Where the groups are substituted by any further substituent(s), the range of the carbon atoms indicates the total carbon atoms including the carbon atoms in the substituent(s).

In the formula (I), at least one $R_1$, $R_2$ and $R_3$ must be an unsubstituted or monosubstituted amino group, and the substituent for the substituted amino group may be selected from an alkyl group, an aryl group and a heterocyclic group.

When at least one of $R_1$, $R_2$ and $R_3$ contains a sulfo group (or a sulfonate group), $R_1$, $R_2$ and $R_3$ contains at least one linear or branched alkyl group and the total carbon atoms in the alkyl group(s) are to be more than 8 in order to make the coupler nondiffusible.

$R_4$ is a hydrogen atom, or a coupling-releasing group.

Where the above-mentioned $R_1$, $R_2$ and $R_3$ contains an aryl group or a heterocyclic group or where the coupling-releasing group for $R_4$ is substituted by an aryl group or a heterocyclic group, the said aryl group or heterocyclic group may optionally be substituted by substituent(s) selected from a halogen atom, a nitro group, a cyano group, a carboxyl group, a sulfonic acid group, an alkyl group, an aryl group, an alkoxy group, an aryloxy group, an alkylthio group, an arylthio group, an amino group, a carbonamido group, a sulfonamido group, a carbamoyl group, a sulfamoyl group, an acyl group, an acyloxy group, an alkoxycarbonyl group, an aryloxycarbonyl group, a heterocyclic group, an alkoxysulfonyl group, an aryloxysulfonyl group, an ureido group, an alkoxycarbonylamino group, an aryloxycarbonylamino group, a sulfamoylamino group, an alkylsulfonyl group and an arylsulfonyl group. (In the present invention an acyl group and an acyl moiety include an aliphatic and aromatic acyl groups and moieties.)

Where $R_1$, $R_2$ or $R_3$ contains an alkyl group or where the coupling-releasing group for $R_4$ is substituted by an alkyl group, the alkyl group may be linear, branched or cyclic and it may be substituted by the substituent(s) mentioned above for the aryl group or heterocyclic group for the above-mentioned $R_1$ to $R_3$.

The coupler of formula (I) may be in the form of a dimer or polymer (including bis-, tris-, tetrakiscompounds and oligomers), where $R_1$, $R_2$, $R_3$ or $R_4$ is a divalent or polyvalent linking group. It may also be in the form of a polymeric coupler, which is bonded to a polymer main chain via anyone of $R_1$, $R_2$, $R_3$ or $R_4$. The limitation on the range of the carbon atoms of the respective substituents mentioned above shall not apply to these cases.

Preferably, $R_1$, $R_2$ and $R_3$ each represent a halogen atom, a substituted or unsubstituted amino group (especially, amino, monoalkylamino, dialkylamino, monoarylamino or diarylamino group), an aryloxy group, an arylthio group, an alkylthio group or a hydrogen atom; and more preferably, they each are an amino group.

$R_4$ preferably represents a hydrogen atom or a coupling-releasing group such as a halogen atom, an alkoxy group, an aryloxy group, an alkylthio group, an arylthio group, a heterocyclic-thio group or a heterocyclic group bonding to the pyrimidine ring via the nitrogen atom thereof, more preferably, it is a hydrogen atom, a halogen atom, an alkoxy group or an alkylthio group, and most preferably, it is a hydrogen atom or a halogen atom.

The couplers of the formula (I) are preferably those represented by the following formula (II) and are more preferably those represented by the following formula (III), from the point of view of coloring properties and easiness of synthesis thereof.

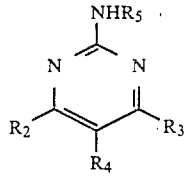

(II)

where $R_2$, $R_3$ and $R_4$ have the same meanings as those in the formula (I); $NHR_5$ is included in the definition of $R_1$ in formula (I), and $R_5$ represents a hydrogen atom, an alkyl group, an aryl group or a heterocyclic group.

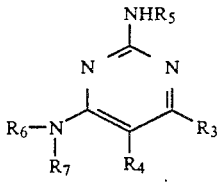

(III)

where $R_3$, $R_4$ and $R_5$ have the same meanings as those in formula (II);

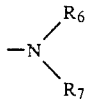

is included in the definition of $R_2$ in formula (I), and $R_6$ and $R_7$ independently represent a hydrogen atom, an alkyl group, an aryl group or a heterocyclic group, or $R_6$ and $R_7$ may be combined to form a heterocyclic ring.

In formulae (II) and (III), $R_5$ is preferably an aryl group and most preferably is a phenyl group.

In the formula (III), one of $R_6$ and $R_7$ in

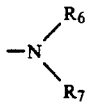

is preferably a hydrogen atom and the other is an aryl group; and in formulae (II) and (III) $R_3$ is preferably a hydrogen atom, a halogen atom, an aryloxy group, an arylthio group, an alkylthio group or a substituted or unsubstituted amino group (especially, monoalkylamino, dialkylamino or anilino group), and it is more preferably a substituted amino group which can be represented by

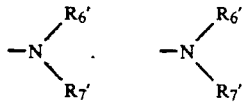

is included in the definition of $R_3$ in formulae (I) and (III), and $R_6'$ and $R_7'$ have the same meanings as $R_6$ and $R_7$.

The couplers of formula (I) give color of yellow to cyan (for example, yellow, orange, red, magenta, blue, cyan or purple). More suitably, they are used as red, magenta, blue or cyan coloring couplers; and most preferably as magenta or blue coloring couplers.

The couplers of formula (I), (II) or (III) may have structures of tautomers. Needless to say, the couplers of the present invention include all the tautomers mentioned below.

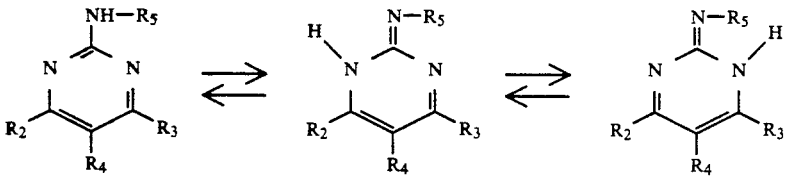

Compounds which are similar to the couplers of formula (I) of the present invention are described in JP-B-43-10773 (corresponding to U.S. Pat. No. 3,615,641) and JP-B-45-22189 (corresponding to U.S. Pat. No. 3,635,721) and JP-A-62-174738. (The terms "JP-B" and "JP-A" as used herein indicate an "examined Japanese patent publication" and an "unexamined published Japanese patent application", respectively.) However, these disclosed compounds have a structure where two pyrimidines are bonded via a sulfonic acid group-containing 4,4'-diaminostilbene, 4,4'-diaminobiphenyl or di-(4-aminophenyl)ethane and are employed as a super-color sensitizer (which is an additive to be added to photographic materials for the purpose of elevating or maintaining the color-sensitizing efficiency of sensitizing dyes contained in the materials or for the purpose of inhibiting the increase of fog to be caused by such sensitizing dyes). Accordingly, the object of these compounds are quite different from that of the couplers of the present invention. Additionally, since the disclosed compounds have a hydrophilic group such as a sulfonic acid group and are therefore soluble in water, they could not give dyes which may be fixed as color images, even though they might form some dyes by color development.

Next, specific examples of groups of the couplers of the formula (I) of the present invention and as examples of the couplers, substituents thereof are mentioned below.

Examples of $R_1$, $R_2$ or $R_3$:

H F Cl Br I $-NH_2$ $-NHCH_3$

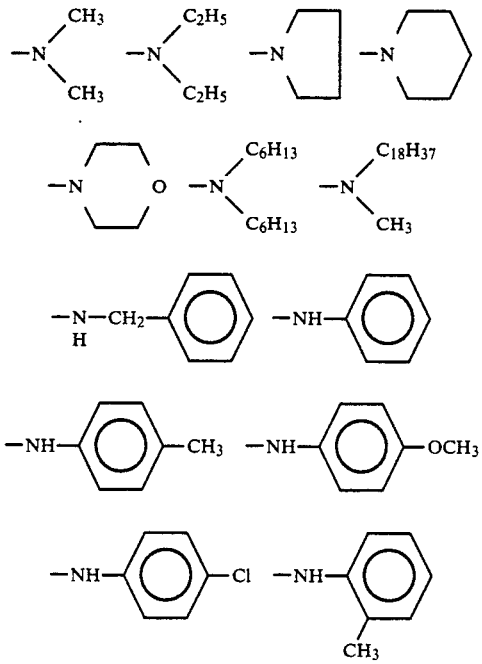

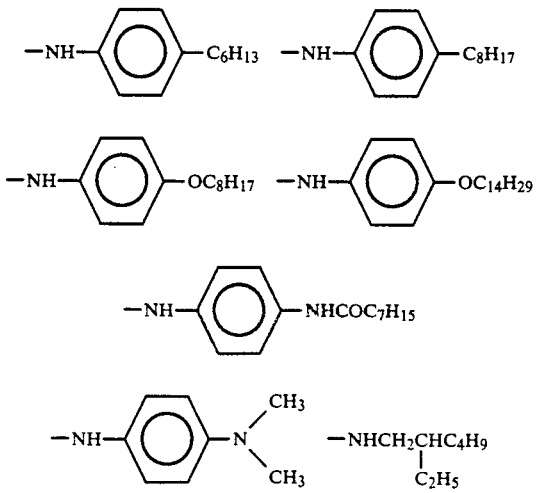

-continued
Examples of $R_1$, $R_2$ or $R_3$:
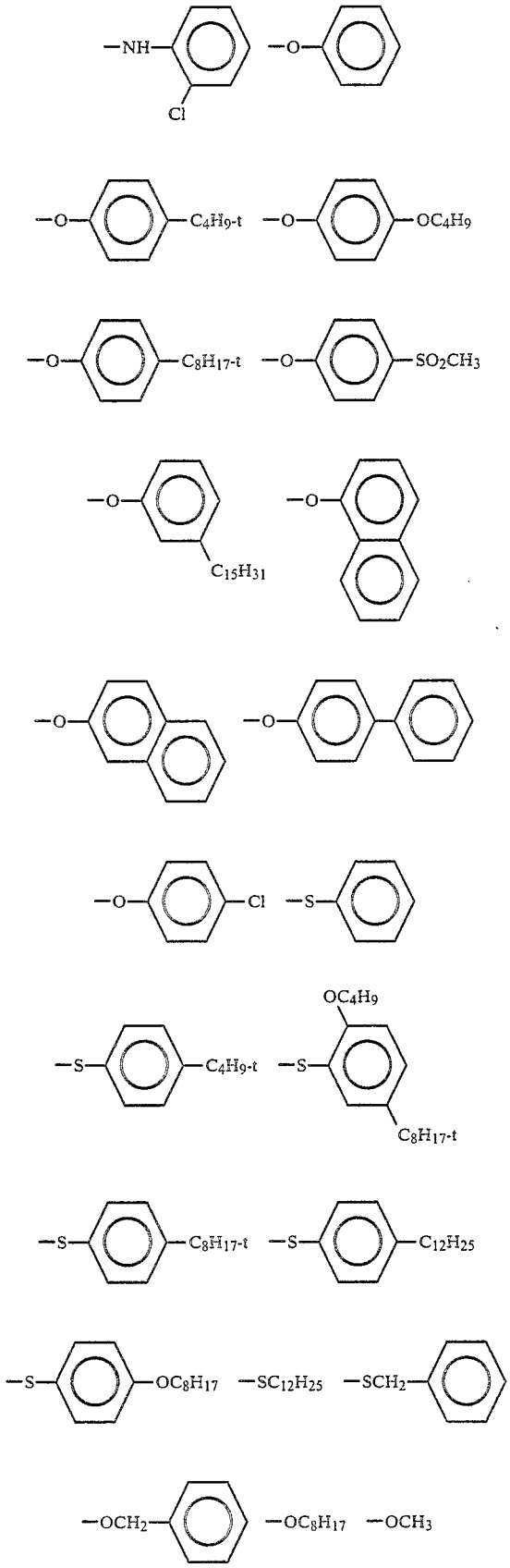
-continued
Examples of $R_1$, $R_2$ or $R_3$:
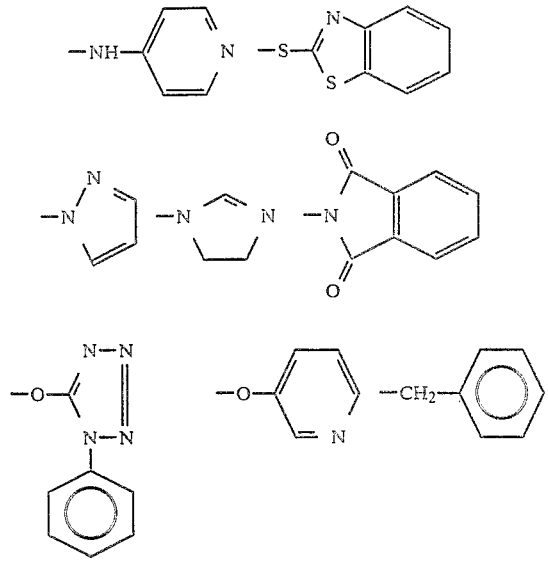
Examples of $R_4$
H F Cl Br I $-SCH_2COOCH_3$ $-SCH_2COOH$
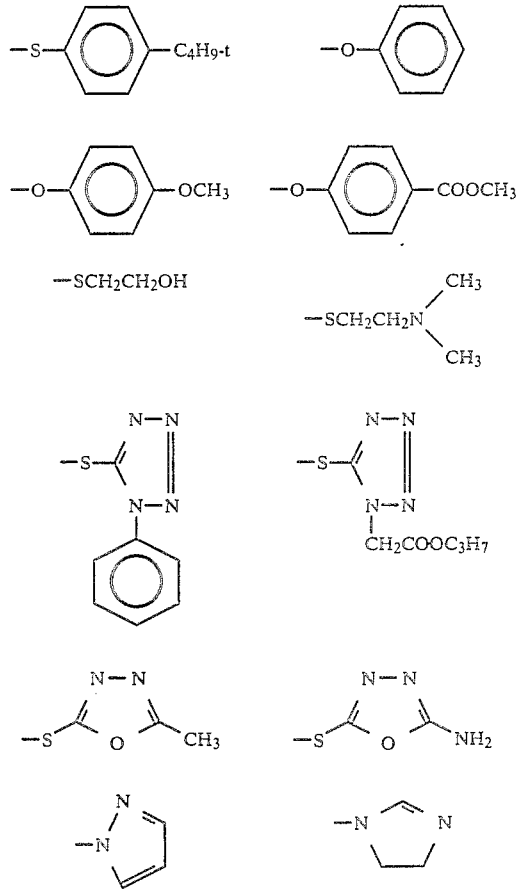

Examples of Couplers of Formula (I)
| Coupler Number | $R_1$ | $R_2$ | $R_3$ | $R_4$ |
|---|---|---|---|---|
| (1) | 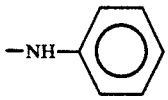 | 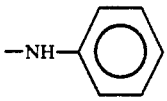 | 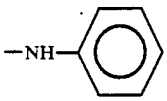 | H |
| (2) | 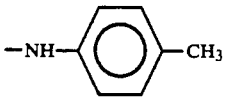 | 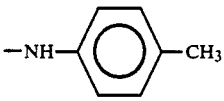 | 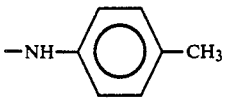 | H |
| (3) | 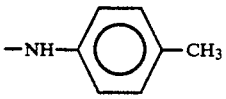 | 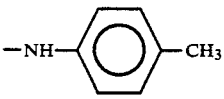 | 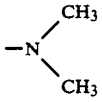 | H |
| (4) | 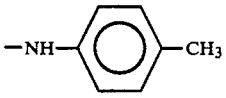 | 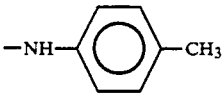 | 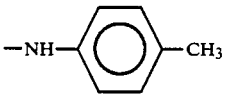 | Cl |
| (5) | 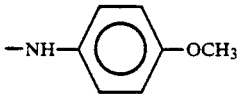 | 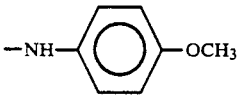 | 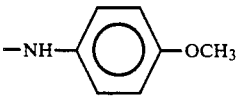 | H |
| (6) | 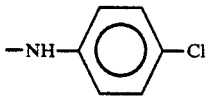 | 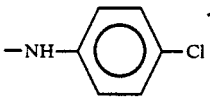 | 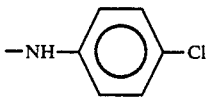 | H |
| (7) | 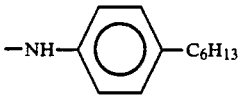 | 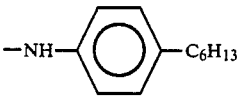 | 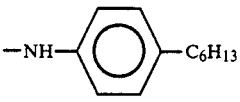 | H |
| (8) | 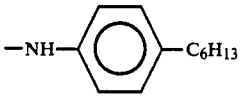 | 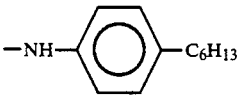 | 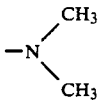 | H |
| (9) | Cl | 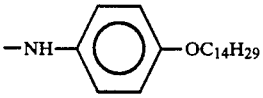 | Cl | H |
| (10) | 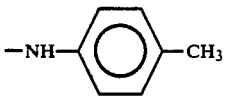 | 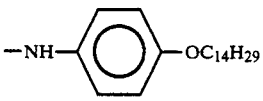 | 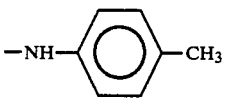 | H |
| (11) | Cl | 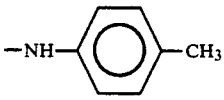 | Cl | H |
| (12) | 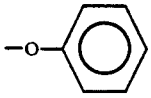 | 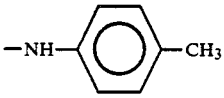 | 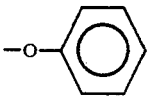 | H |
| (13) | 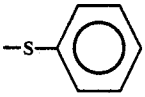 | 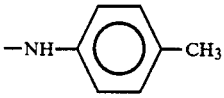 | 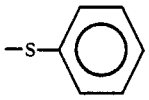 | H |

-continued
Examples of Couplers of Formula (I)
| Coupler Number | $R_1$ | $R_2$ | $R_3$ | $R_4$ |
|---|---|---|---|---|
| (14) | 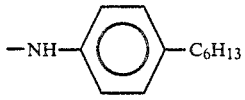 | 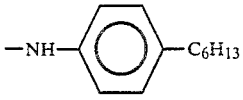 | 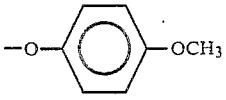 | H |
| (15) | 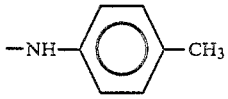 | 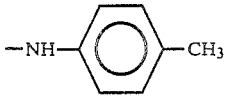 | 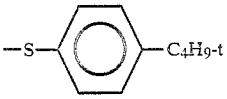 | H |
| (16) | 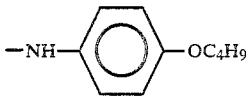 | 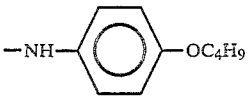 | 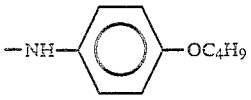 | $-SCH_2COOH$ |
| (17) | 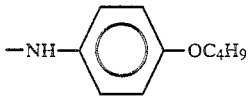 | 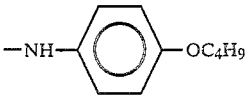 | 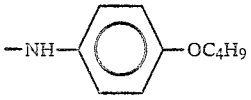 | 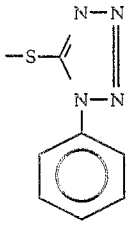 |
| (18) | 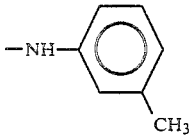 | 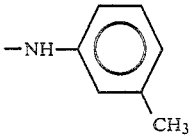 | 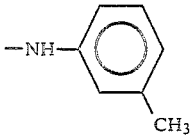 | 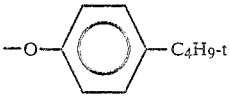 |
| (19) | 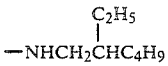 | 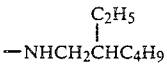 | 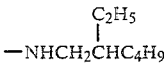 | H |
| (20) | 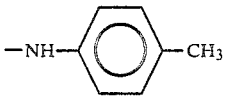 | 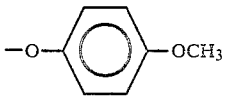 | 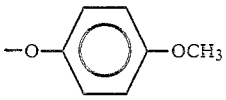 | H |
| (21) | 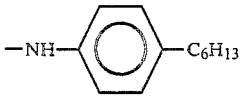 | 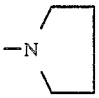 | 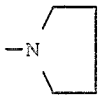 | Cl |
| (22) | 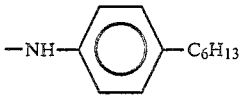 | 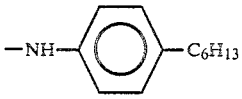 | H | Cl |
| (23) | 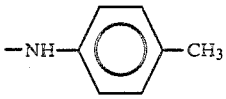 | 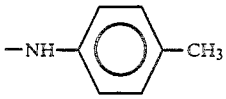 | 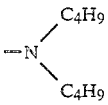 | H |
| (24) | 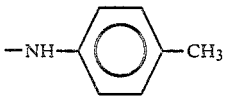 | 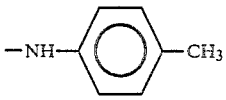 | 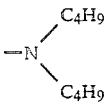 | Cl |
| (25) | 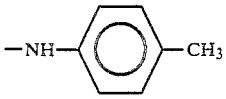 | 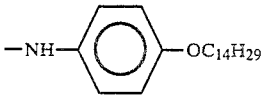 | 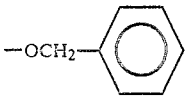 | Cl |

-continued

Examples of Couplers of Formula (I)

| Coupler Number | $R_1$ | $R_2$ | $R_3$ | $R_4$ |
|---|---|---|---|---|
| (26) | 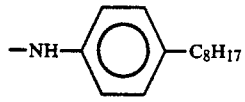 | 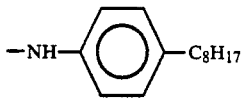 | 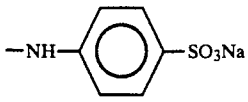 | H |
| (27) | 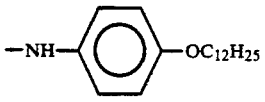 | H | H | H |
| (28) | 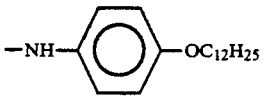 | 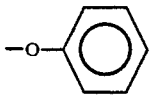 | H | H |

The couplers of formula (I) can be produced by various methods. Most typically, there is mentioned a method of reacting a halogenopyrimidine (e.g., monochloropyrimidine, dichloropyrimidine or trichloropyrimidine) and an ammonia, mono-substituted amine, disubstituted amine, alcohol, phenol or thiol preferably in an amount of from 0.5 to 10 equivalents to the halogenopyrimidine, all at one time or little by little. In the method, it is preferred (from the point of view of the yield) to add a base to the reaction system, generally, in an amount of from 0.1 to 10 equivalents to the halogenopyrimidine therein. The base usable for the purpose preferably includes sodium hydroxide, potassium hydroxide, sodium acetate, potassium acetate, sodium carbonate, potassium carbonate, pyridine, triethylamine, t-butoxy potassium, diazabicycloundecene and sodium hydride. Where amines are employed for the substitution reaction, addition of such base would be unnecessary but some excess amines may be employed. As the reaction solvent for the method, N,N-dimethylformamide, N,N-dimethylacetamine, N,N'-dimethylimidazolin-2-one, dimethylsulfoxide, hexamethylphosphoryltriamide, acetonitrile, tetrahydrofuran, dioxane, diglyme, toluene, xylene or the like is preferred. The concentration of the halogenopyrimidine in the solvent preferably is from $1\times10^{-3}$ mol/l to 10 mol/l. The reaction temperature is suitably within the range of from −78° C. to 200° C., preferably from −20° C. to 160° C.

The reaction time is preferably within the range of approximately from 0.5 to 5 hours.

Production examples of couplers of the present invention are mentioned below. Other couplers of the present invention can also be synthesized in accordance with these methods.

PRODUCTION EXAMPLE 1

Production of Exemplified Couplers (2) and (3)

5.5 g of 2,4,6-trichloropyrimidine, 12.9 g of p-toluidine and 22 g of potassium carbonate were dispersed in 50 ml of N,N-dimethylformamide and gradually heated with stirring. Accordingly, the whole was heated at 100° C. for 1 hour and then at 170° C. for 2 hours. 200 ml of water was added to the resulting reaction solution and the solid as precipitated was taken out by filtration and dried. Couplers (2) and (3) were separated by column chromatography using a mixed solvent of n-hexane/ethyl acetate (5/1, by volume) as a developer and a silica gel as a filler. The resulting fractions were separately concentrated and crystallized out the products from acetonitrile. As a result, 4.4 g of the intended Coupler (2) (having a m.p. of 238° to 241° C.) and 3.4 g of the intended Coupler (3) (having a m.p. of 180° to 181° C.) were obtained. The structures of the compounds were identified by elementary analysis, mass-spectrum and NMR-spectrum. (The same shall apply hereunder.)

PRODUCTION EXAMPLE 2

Production of Exemplified Coupler (4)

2 g of the Coupler (2) was dispersed in 30 ml of methylene chloride, and 0.8 g of sulfuryl chloride was dropwise added thereto with stirring at room temperature. After being stirred for 1 hour, the reaction solution was washed with water and concentrated. 20 ml of acetonitrile was added to the residue for crystallization, and 1.8 g of the intended compound was obtained. It has m.p. of 148° to 151° C.

PRODUCTION EXAMPLE 3

Production of Exemplified Couplers (7) and (8)

5.5 g of 2,4,6-trichloropyrimidine, 17.6 g of p-hexylaniline and 12.4 g of potassium carbonate were dispersed in 50 ml of N,N-dimethylacetamide and gradually heated (at 50° C. for 1 hour and at 80° C. for 1 hour) with stirring. Additionally, the whole was heated at 150° C. for 2 hours. 200 ml of ethyl acetate was added to the reaction solution, which was then washed with water, extracted and concentrated. The resulting residue was derived to Couplers (7) and (8) by column chromatography using a mixed solvent of n-hexane/ethyl acetate as a developer and a silica gel as a filler. Thus obtained fractions were purified. After crystallization from methanol, 6.2 g of the intended Coupler (7) was obtained, which had a m.p. of 117° to 119° C. After crystallization from acetonitrile, on the other hand, 4.4 g of the intended Coupler (8) was obtained, which had m.p. of 116° to 117.5° C.

PRODUCTION EXAMPLE 4

Production of Exemplified Coupler (10)

6.1 g of p-tetradecyloxyaniline and 2.0 g of triethylamine were dissolved in 50 ml of N,N'-dimethylimidazolidin-2-one, and 3.7 g of 2,4,6-trichloropyrimidine was dropwise added thereto with stirring at room temperature. After being stirred for 1 hour, 8.6 g of p-toluidine was added to the reaction mixture, which was then heated at 100° C. for 1 hour and then at 180° C. for 3 hours. After the reaction solution was cooled, 200 ml of water was added thereto little by little. The crystal thus precipitated was taken out by filtration. This was recrystallized from acetonitrile, and 7.4 g of the intended Coupler (10) was obtained, which had m.p. of 151° to 154° C.

PRODUCTION EXAMPLE 5

Production of Exemplified Coupler (12)

6.4 g of p-toluidine was dissolved in 50 ml of tetrahydrofuran, and 5.5 g of 2,4,6-trichloropyrimidine was dropwise added thereto with stirring at room temperature. After being stirred for 1 hour, 200 ml of water was added to the reaction mixture. The crystal thus precipitated was taken out by filtration and dried to obtain 6.6 g of 2,4-dichloro-6-p-toluidinopyrimidine, which had a m.p. of 162° to 166° C. Next, 2.4 g of phenol and 8.6 g of potassium carbonate were dispersed in 30 ml of N,N'-dimethylimidazolin-2-one, and 2.54 g of the previously prepared 2,4-dichloro-6-p-toluidinopyrimidine was added thereto with stirring and then heated at 150° C. for 2 hours. After the reaction solution was cooled, 100 ml of ethyl acetate was added thereto. The solution was then washed with water and extracted. The resulting ethyl acetate extract was concentrated, and methanol was added to the residue for crystallization. Accordingly, 3.4 g of the intended Coupler (12) was obtained, which had a m.p. of 151° to 152° C.

The coupler of the formula (I) of the present invention can be added to silver halide color photo graphic materials in the various layers thereof, such as the light-sensitive silver halide emulsion layers (for example, red-sensitive silver halide emulsion layer, green-sensitive silver halide emulsion layer, blue-sensitive silver halide emulsion layer, etc.), light-insensitive silver halide emulsion layers, interlayers and others. In general, however, it is added to the light-sensitive silver halide emulsion layers or the adjacent layers. The amount of the coupler of formula (I) to be placed in the photographic material is generally from $1\times10^{-5}$ mol/m$^2$ to $1\times10^{-2}$ mol/m$^2$, preferably from $1\times10^{-4}$ mol/m$^2$ to $5\times10^{-3}$ mol/m$^2$, more preferably from $2\times10^{-4}$ mol/m$^2$ to $1\times10^{-3}$ mol/m$^2$.

The light-sensitive silver halide to be placed in the silver halide emulsion layers is desirably silver bromide, silver iodobromide, silver chloride, silver chlorobromide or silver chloroiodobromide.

The couplers of formula (I) of the present invention can be employed along with conventional known 2-equivalent or 4-equivalent cyan, magenta or yellow couplers (for example, phenol or naphthol cyan couplers, 3-anilino-5-pyrazolone magenta couplers, 3-acylamino-5-pyrazolone magenta couplers, pyrazolotriazole magenta couplers, pivaloylacetanilide yellow couplers, benzoylacetanilide yellow couplers).

Additionally, the couplers of the present invention are useful as couplers in a coloring reagent composition wherein there is a combined multi-layer analysis element having a coloring reagent layer and a porous developer layer on a transparent support, as described in JP-A-49-53888 (U.S. Pat. No. 3,992,158), JP-A-55-164356 (U.S. Pat. No. 4,292,272) and JP-A-60-222769 (European Patent 0162302A), or wherein there is a combined multi-layer analysis element having plural porous layers laminated keeping porous property on a transparent support, as described in JP-A-61-4959 (European Patent 0166365A).

Next, the constitutional elements in the silver halide color photographic materials of the present invention, the additives to be added thereto and the color development process to be applied thereto are described in detail hereunder.

The color photographic materials of the present invention are prepared by coating at least one blue-sensitive silver halide emulsion layer, at least one green-sensitive silver halide emulsion layer and at least one red-sensitive silver halide emulsion layer on a support. An ordinary color photographic paper generally has its light-sensitive emulsion layers coated on the support in the order as mentioned above. However, the layers may be coated on the support in other orders than that mentioned above. Additionally, an infrared-sensitive silver halide emulsion layer may be employed in place of at least one of the above-mentioned emulsion layers. Each of these light-sensitive emulsion layers contains a silver halide emulsion having a sensitivity in the determined wavelength range and a so-called color coupler capable of forming a dye which is complementary to the color of the sensitive light (that is, yellow to blue, magenta to green, and cyan to red) whereby the respective layers may reproduce the intended colors by subtractive color photography. However, the combination of the light-sensitive layer and the coloring hue of the coupler therein is not limited to only the above-mentioned constitutions.

The silver halide emulsion for use in the present invention .preferably comprises silver chlorobromide or silver chloride which is substantially free from silver iodide. The silver halide which is substantially free from silver iodide as referred to herein means that the silver iodide content in the halide is 1 mol % or less, preferably 0.2 mol % or less. The halogen composition in the emulsions may differ from one another between the silver halide grains or may be same in them. Employment of an emulsion where the halogen composition is same in the silver halide grains therein facilitates uniformalization of the properties of the respective grains in the emulsion. Regarding the halogen composition distribution in the inside of the respective silver halide emulsion grains, so-called uniform structural grains where the halogen composition is same in any portion of the silver halide grains, or so-called laminate structural grains where the halogen composition differ between the core of the inside of the silver halide grain and the shell surrounding the core (the shell being composed of one layer or plural layers), or composite structural grains which have different non-layered halogen composition portions in the inside or on the surface of the grain (where such different non-layered halogen composition portions are on the surface of the grain, the different composition portions are conjugated on the edges, corners or faces thereof) may properly be selected for use in the present invention. The latter two grains (laminate grains, composite grains) are preferred to the first uniform structural grains for the purpose of obtaining a higher sensitivity and also in view of the higher pressure-resistance. Where the silver halide grains for use in the present invention have any one of the above-mentioned structures, the boundary between the portions each having a different halogen composition may be either a definite boundary or an indefinite boundary to form a mixed crystal because of the difference in the halogen compositions. Additionally, the boundary therebetween may positively have continuous structure variation in the halogen compositions.

The halogen composition of the silver chlorobromide emulsion of the present invention may have any desired ratio of silver bromide/silver chloride. The ratio may widely be varied in accordance with the above objects, but the proportion of silver chloride is preferably 2% or more in the emulsion.

A so-called high silver chloride emulsion having a high silver chloride content is preferably used in the photographic materials which are especially suitable to high-speed processing. The silver chloride content in the high silver chloride emulsion is preferably 90 mol % or more, especially preferably 95 mol % or more.

In the high silver halide emulsions as mentioned above,, the grains preferably have a silver bromide-locallized phase-having a structure where a silver bromide-locallized phase is in the inside and/or on the surface of the silver halide grain in the form of a layer or non-layer as mentioned above. The halogen composition in the locallized phase preferably has at least 10 mol % of the silver bromide content, more preferably more than 20 mol % thereof. The locallized phase may be in the inside of the grain or on the edges, corners or faces of the surface of the grain. As one preferred embodiment, the phase may grow on the corners of the grain as epitaxial growth.

On the other hand, for the purpose of most suppressing or lowering of the sensitivity when the photographic material has received a pressure, even the high silver chloride grain having a silver chloride content of 90 mol % or more, preferably has a uniform structure having a narrow halogen composition distribution therein.

For the purpose of reducing the amount of the replenisher or the developer to be used for processing the photographic material, further elevation of the silver chloride content in the silver halide emulsion is effective. In such case, an emulsion comprising almost pure silver chloride grains having a silver chloride content of from 98 mol % to 100 mol % may also preferably be employed.

The mean grain size of the silver halide grains to be contained in the silver halide emulsion for use in the present invention is preferably from 0.1 micron to 2 microns. (The grain size corresponds to the diameter of a circle having the same projection area of the grain, and the mean grain size corresponds to the number average value of the respective grain sizes.)

Regarding the grain size distribution, a so-called monodispersed emulsion is preferred, which has a fluctuation coefficient (obtained by dividing the standard deviation of the grain size distribution by the mean grain size) of being 20% or less, preferably 15% or less. In the photographic materials of the present invention, it is also preferred that different mono-dispersed emulsions are blended and incorporated into one layer, or that they are incorporated into different layers to be laminated, for the purpose of obtaining a broad photographic latitude.

The silver halide grains in the photographic emulsion may be those having a regular crystalline form such as a cubic, octahedral or tetradecahedral crystalline form, or those having an irregular crystalline form such as a spherical or tabular crystalline form, or those having a composite form of various crystal forms. Additionally, the grains may be a mixture of various grains having different crystalline forms. In the present invention, it is preferred that the content of the above-mentioned regular crystalline grains is 50% or more, more preferably 70% or more, especially preferably 90% or more, in the emulsion.

Additionally, an emulsion containing tabular grains having a mean aspect ratio (ratio of circle-corresponding to diameter/thickness) of 5 or more, preferably 8 or more, in a proportion of more than 50% of the total grains in the projected area, is also preferably employed in the present invention.

Silver chlorobromide emulsions for use in the present invention can be prepared by the methods described in P. Glafkides, *Chimie et Physique Photographique* (published by Paul Montel Co. in 1967), G. F. Duffin, *Photographic Emulsion Chemistry* (published by Focal Press Co. in 1966) and V. L. Zelikman et al., *Making and Coating Photographic Emulsion* (published by Focal Press Co. in 1964). Precisely, they may be prepared by an acid method, neutral method or ammonia method. Where they are prepared in a system in which a soluble silver salt and soluble halides are reacted, any method of single jet method, double jet method and combination thereof may be employed. A so called reversed jet method where the grains are formed in the atmosphere of excess silver ions may also be employed. As one system of the double jet method, a so-called controlled double jet method where the pAg value in the liquid phase of forming silver halide grains is kept constant may also be employed. According to the method, silver halide grains having regular crystalline forms and having almost uniform grain sizes can be obtained.

Various polyvalent metal ion impurities may be introduced into the silver halide emulsions for use in the present invention, in the step of forming the grains or of physical ripening thereof. Examples of the compounds usable for such a purpose include salts of cadmium, zinc, lead, copper or thallium, as well as salts or complex salts of elements of the Group VIII of the Periodic Table, such as iron, ruthenium, rhodium, pallasium, osmium, iridium or platinum. In particular, the elements of the Group VIII are preferably employed. The amount of the compound to be added to the emulsions may broadly vary in accordance with the object, and it is preferably from $10^{-9}$ to $10^{-2}$ mol per mol of the silver halide in the emulsions.

The silver halide emulsions for use in the present invention are generally chemically sensitized or spectrally sensitized.

For chemical sensitization of the emulsions, sulfur sensitization by typically adding an unstable sulfur compound to the emulsion, noble metal sensitization such as gold sensitization, as well as reduction sensitization can be employed singly or in combination. The compounds preferably usable in such chemical sensitization are described in JP-A-62-215272, from page 18, right-lower column to page 22, right-upper column.

Spectral sensitization is effected for the purpose of imparting spectral sensitivity in the desired light wavelength range to the emulsions of the respective layers of the photographic material of the present invention. In accordance with the present invention, such spectral sensitization is preferably effected by adding a dye (spectrally sensitizing dye) which absorbs the light of a wavelength range corresponding to the intended spectral sensitivity to the photographic emulsion utilized As examples of the spectrally sensitizing dyes usable for the purpose, the compounds described in F. M. Harmer, *Heterocyclic Compounds—Cyanine Dyes and Related Compounds* (published by John Wiley & Sons Co. of New York, London, in 1964) are referred to. Specific examples of such compounds are described in the above-mentioned JP-A-62-215272, from page 22, right-upper column to page 38, and these are preferably employed in the present invention.

Silver halide emulsions used in the present invention can contain various compounds, or precursors thereof for preventing fog during manufacture of the photographic materials, storage thereof or photographic processing thereof or for the purpose of stabilizing the photographic properties of the materials. Specific examples of the compounds which are preferably used for the purposes are described in the above-mentioned JP-A-62-215272, pages 39 to 72.

The emulsions for use in the present invention may be either so-called surface latent image type emulsions which form latent images essentially on the surfaces of the grains or so-called internal latent image type emulsions which form the same essentially in the insides of the grains.

In accordance with the present invention, various known techniques can be employed for the purpose of adding the above-mentioned couplers to the light-sensitive layers. In general, an oil-in-water dispersion method which is known as an oil-protect method can be employed for the purpose, where the coupler is dissolved in a solvent and the resulting solution is dispersed by emulsification in an aqueous gelatin solution containing a surfactant. Alternatively, water or an aqueous gelatin solution may be added to a coupler solution containing a surfactant to form an oil-in-water dispersion by phase conversion. Alkali-soluble couplers may also be dispersed by a so-called Fisher dispersion method. The low boiling point organic solvent, if any, may be removed from the resulting coupler dispersion by distillation, noodle washing or ultrafiltration, and the dispersion may then be blended with the photographic emulsion.

As the dispersion medium for such couplers, a high boiling point organic solvent and/or a water-insoluble high polymer compound having a dielectric constant (at 25° C.) of from 2 to 20 and a refractive index (at 25° C.) of from 1.5 to 1.7 are/is preferably employed in the present invention.

As the high boiling point organic solvent, those represented by the following general formulae (A) to (E) can be used.

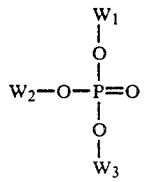
(A)

$W_1-COO-W_2$ (B)

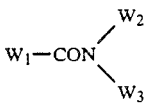
(C)

-continued

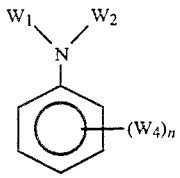
(D)

$W_1-O-W_2$ (E)

In these formulae, $W_1$, $W_2$ and $W_3$ each represents a substituted or unsubstituted alkyl, cycloalkyl, alkenyl, aryl or heterocyclic group, $W_4$ represents $W_1$, $OW_1$ Or $SW_1$, n represents an integer of from 1 to 5; and when n is 2 or more, plural $W_4$'s may be same or different. In the formula (E), $W_1$ and $W_2$ may together form a condensed ring.

In the present invention other high boiling point organic solvents than those of the above-mentioned formulae (A) to (E) may also be employed, provided that they are water-immiscible compounds having a melting point of 100° C. or lower and a boiling point of 140° C. or higher and they are good solvents for the couplers of the present invention. The high boiling point organic solvents to be employed in the present invention preferably have a melting point of 80° C. or lower and a boiling point of 160° C. or higher, more preferably 170° C. or higher.

The details of such high boiling point organic solvents are described in JP-A-62-215272, from page 137, right-lower column to page 144, right-upper column.

The couplers of the present invention may also be penetrated into a loadable latex polymer (for example, as described in U.S. Pat. No. 4,203,716) in the presence or absence of the above-mentioned high boiling point organic solvent or dissolved in a water-insoluble and organic solvent-soluble polymer and the resulting latex polymer or polymer may be dispersed by emulsification into the aqueous hydrophilic colloid solution.

Preferably, the homopolymers or copolymers described in International Patent Application Laid-Open No. WO 88/00723, pages 12 to 30 are used for the above-mentioned means, and employment of acrylamide polymers is especially preferred in view of stabilization of the dye images to be formed.

The photographic material of the present invention can contain hydroquinone derivatives, aminophenol derivatives, gallic acid derivatives or ascorbic acid derivatives as color-fogging inhibitors.

The photographic materials of the present invention can contain various anti-fading agents. As typical examples of organic anti-color fading agents which can be used for cyan, magenta and/or yellow images, there are mentioned hindered phenols such as hydroquinones, 6-hydroxychromans, 5-hydroxycoumarans, spirochromans, p-alkoxyphenols or bisphenols, as well as gallic acid derivatives, methylenedioxybenzenes, aminophenols and hindered amines and additionally ether or ester derivatives thereof formed by silylating or alkylating the phenolic hydroxyl group of the compounds. Further, metal complexes such as (bissalicylaldoximato) nickel complexes and (bis-N,N-dialkyldithiocarbamato)-nickel complexes can also be used.

Specific examples of the organic anti-color fading agents usable in the present invention are described in the following patent specifications.

Precisely, hydroquinones are described in U.S. Pat. Nos. 2,360,290, 2,418,613, 2,700,453, 2,701,197, 2,728,659, 2,732,300, 2,735,765, 3,982,944, and 4,430,425, British Patent 1,363,921, and U.S. Pat. Nos. 2,710,801, 2,816,028; 6-hydroxychromans, 5-hydroxycoumarans and spirochromans are described in U.S. Pat. Nos. 3,432,300, 3,573,050, 3,574,627, 3,698,909, and 3,764,337 and JP-A-52-152225; spiroindanes are described in U.S. Pat. No. 4,360,589; p-alkoxyphenols are described in U.S. Pat. No. 2,735,765, British Patent 2,066,975, JP-A-59-10539 and JP-B-57-19765; hindered phenols are described in U.S. Pat. No. 3,700,455, JP-A-52-72224, U.S. Pat. No. 4,228,235 and JP-B-52-6623; gallic acid derivatives, methylenedioxybenzenes and aminophenols are described in U.S. Pat. Nos. 3,457,079, 4,332,886 and JP-B-56-21144; hindered amines are described in U.S. Pat. Nos. 3,336,135, 4,268,593, British Patents 1,326,889, 1,354,313, 1,410,846, JP-B-51-1420, JP-A-58-114036, JP-A-59-53846 and JP-A-59-78344; and metal complexes are described in U.S. Pat. Nos. 4,050,938, 4,241,155 and British Patent 2,027,731(A). These compounds may be added to the light-sensitive layer in an amount of, generally, from 5 to 100% by weight to the corresponding coupler, by co-emulsifying the same along with the coupler, whereby the intended objective can be attained. In order to prevent the cyan color image from being deteriorated by heat and especially by light, it is more effective to add an ultraviolet absorbent to the cyancoloring layer and both adjacent layers thereto.

As ultraviolet absorbents usable for this purpose, there are mentioned, for example, aryl group-substituted benzotriazole compounds (for example, those described in U.S. Pat. No. 3,533,794), 4-thiazolidone compounds (for example, those described in U.S. Pat. Nos. 3,314,794 and 3,352,681), benzophenone compounds (for example, those described in JP-A-46-2784), cinnamic acid ester compounds (for example those described in U.S. Pat. Nos. 3,705,805 and 3,707,395), butadiene compounds (for example those described in U.S. Pat. No. 4,045,229), and benzoxidol compounds (for example those described in U.S. Pat. Nos. 3,406,070, 3,677,672 and 4,271,307). Additionally, ultraviolet-absorbing couplers (for example, cyan dye-forming alpha-naphthol couplers) or ultraviolet-absorbing polymers may also be employed. Such ultraviolet absorbents may be mordanted in particular layers of the photographic material of the invention.

Above all, the above-mentioned aryl group-substituted benzotriazole compounds are preferred.

Along with the above-mentioned couplers, the compounds mentioned .below are especially preferably employed. These are especially preferable when combined with pyrazoloazole couplers.

Specifically, compounds (F) which may chemically bond with aromatic amine developing agent remaining after color development to give a chemically inactive and substantially colorless compound and/or compounds (G) which may chemically bond with the oxidation product of the aromatic amine developing agent remaining after color development to give a chemically inactive and substantially colorless compound, are preferably employed simultaneously or singly. Employment of such compounds is preferred, for example, for preventing stains caused by formation of colored dyes which result from a reaction between the developing agent or the oxidation product thereof remaining in the film, and the coupler, during storage of the material processed, and also for preventing other harmful side-reaction.

As the compounds (F), preferred are compounds which react with p-anisidine with a secondary reaction speed constant $k_2$ (in trioctyl phosphate at 80° C.) of from 1.0 liter/mol·sec to $1\times10^{-5}$ liter/mol·sec. The secondary reaction speed constant can be measured by the method described in JP-A-63-158545.

If the value $k_2$ is larger than the range, the compounds themselves would be unstable and would often react with gelatin and water to decompose. On the other hand, if it is smaller than the range, the reaction speed of the compound with the remaining aromatic amine developing agent would be low and, as a result, the object to prevent the harmful side effects of the remaining aromatic amine developing agent could not be attained.

More preferred examples of such compounds (F) are those represented by the following formula (FI) or (FII).

$$R_1-(A)_n-X \qquad \text{(FI)}$$

$$R_2-\underset{\underset{B}{|}}{C}=Y \qquad \text{(FII)}$$

In these formulae, $R_1$ and $R_2$ each represents an aliphatic group, an aromatic group or a heterocyclic group; n represents 1 or 0; A represents a group capable of reacting with an aromatic amine developing agent to form a chemical bond; X represents a group capable of reacting with an aromatic amine developing agent to be released; B represents a hydrogen atom, an aliphatic group, an aromatic group, a heterocyclic group, an acyl group or a sulfonyl group; and Y represents a group capable of accelerating addition of an aromatic amine developing agent to the compound of formula (FII). $R_1$ and X; and Y and $R_2$ or B may be bonded to each other to form a cyclic structure.

Typical methods of reacting the compounds and the remaining aromatic amine developing agent by chemically bonding, are by substitution reaction and addition reaction.

Specific examples of the compounds of the formula (FI) and (FII) are described in JP-A-63-158545 and JP-A-62-283338 and European Patent Laid-Open Application Nos. 298321 and 277589 and are preferably employed in the present invention.

On the other hand, as compounds (G) which chemically bond with the oxidation product of the aromatic amine developing agent remaining after color development to give a chemically inert and substantially colorless compound, more preferred are those as represented by the following formula (GI):

$$R-Z \qquad \text{(GI)}$$

where R represents an aliphatic group, an aromatic group or a heterocyclic group; and Z represents a nucleophilic group or a group capable of releasing a nucleophilic group after decomposed in the photographic material. In the compounds of the formula (GI), Z is preferably a group having a nucleophilic $nCH_3I$ value (R. G. Pearson, et al., *J. Am. Chem. Soc.*, 90, 319 (1968)) of 5 or more or a group to be derived therefrom.

Specific examples of the compounds of formula (GI) are described in European Patent Laid-Open Application No. 255722, JP-A-62-143048 and JP-A-62-229145, Japanese Patent Application No. 63-136724 and JP-A-H-1-57259 and European Patent Laid-Open Application Nos. 298321 and 277589, and are preferably used in the present invention.

The details of the combination of the above-mentioned compounds (G) and compounds (F}are described in European Patent Laid-Open Application No. 277589.

The photographic material of the present invention can contain water-soluble dyes, or dyes which may become water-soluble by photographic processing, in the hydrophilic colloid layers as a filter dye or for the purpose of anti-irradiation or anti-halation or for other various purposes. Such dyes include, for example, oxonole dyes, hemioxonole dyes, styryl dyes, merocyanine dyes, cyanine dyes and azo dyes. Above all, oxonole dyes, hemioxonoles dyes and merocyanine dyes are useful.

As the binder or protective colloid which can be used in the emulsion layer of the photographic material of the present invention, gelatin is advantageously used. However, any other hydrophilic colloid may also be employed singly or in combination with gelatin.

The gelatin to be used in the present invention may be either a lime-processed gelatin or an acid-processed gelatin. The details of the preparation of such gelatins are described in Arthur Vais, *The Macromolecular Chemistry of Gelatin* (published by Academic Press in 1964).

As supports for use in the present invention, there are mentioned transparent films such as cellulose nitrate film or polyethylene terephthalate film, and reflective supports which are generally employed in ordinary photographic materials. Employment of the latter reflective supports is preferred in the present invention in view of the objects.

The reflective supports which can be employed in the present invention are preferably those which can improve the reflectivity of the supports so that the color image as formed on the silver halide emulsion layer is made sharp. Such reflective supports include supports prepared by coating a hydrophobic resin which contains a light-reflective substance such as titanium oxide, zinc oxide, calcium carbonate or calcium sulfate dispersed therein, on a support base or a support made of a hydrophobic resin which contains the light-reflecting substance dispersed therein. For instance, there are mentioned baryta paper, polyethylene-coated paper, synthetic polypropylene paper, as well as transparent supports (e.g., glass sheet, polyester films such as polyethylene terephthalate, cellulose triacetate or cellulose nitrate, or polyamide films, polycarbonate films, polystyrene films or vinyl chloride resin films) coated with a reflective layer or containing a reflecting substance.

In addition, supports having a metal surface with mirror reflectivity or secondary diffusion-reflectivity may also be employed as the reflective support in preparing the photographic materials of the present invention. The metal surface is preferably one having a spectral reflectivity of 0.5 or more in the wavelength range of visible lights, and it is also preferred to roughen the metal surface or to impart a diffusive reflectivity thereto by the use of a metal powder. Such metal may be selected from aluminium tin, silver, magnesium and alloys thereof. The surface may be that of a metal sheet, metal foil or thin metal layer prepared by rolling, vacuum evaporation or plating. Above all, the metal surface is preferably prepared by coating a metal over a substrate of a different material by vacuum evaporation. Provision of a water-resistant resin, especially a thermoplastic resin layer, over the metal surface is preferred. Supports having the above-mentioned metal surface, which are used in the present invention, preferably have an antistatic layer on their other surfaces opposite to the metal surface. The details of such supports are described, for example, in JP-A-61-210346, JP-A-63-24247, JP-A-63-24251 and JP-A-63-24255.

The supports may properly be selected in accordance with the object and use thereof.

As the above-mentioned light-reflecting substance, it is preferred that a white pigment is fully kneaded in the presence of a surfactant. Pigment grains surface-treated with a 2- or 4-valent alcohol are also preferably employed.

Where fine grains of a white pigment are incorporated into the support, the exclusive area ratio (%) of the grains per unit area is obtained most typically by dividing the observed area into the adjacent unit area of 6 $\mu m \times 6$ $\mu m$ and measuring the exclusive area ratio (%) (Ri) of the fine grains as projected to the unit area. The fluctuation coefficient of the exclusive area ratio (%) can be obtained as the ratio s/R, which is the ratio of the standard deviation (s) of Ri to the mean value (R) of Ri. The number (n) of the unit areas for the measurement is preferably 6 or more. Accordingly, the fluctuation coefficient s/R can be obtained from the following formula:

$$\sqrt{\frac{\sum_{i=1}^{n} (Ri - R)^2}{n - 1}} \Big/ \frac{\sum_{i=1}^{n} Ri}{n}.$$

In accordance with the present invention, the fluctuation coefficient of the exclusive area ratio (%) of the fine pigment grains is preferably 0.15 or less, especially 0.12 or less. If it is 0.08 or less, it can be said that the dispersibility of the grains is substantially "uniform".

The color development solution for use in development of the photographic materials of the present invention is preferably an aqueous alkaline solution consisting essentially of an aromatic primary amine developing agent. As the color developing agent for the developer, p-phenylenediamine compounds are preferably used, although aminophenol compounds are useful. Specific examples of the compounds include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-ethyl-N-$\beta$-methoxyethylaniline and sulfates, hydrochlorides and p-toluenesulfonates thereof. Two or more of these compounds may be used in combination, in accordance with the objects.

The color developer generally contains a pH buffer such as an alkali metal carbonates or phosphates and a development inhibitor or an antifoggant such as bromides, iodides, benzimidazoles, benzothiazoles or mercapto compounds. In addition, the developer may further contain, if desired, various preservatives such as hydroxylamine, diethylhydroxylamine, sulfites, hydrazines (e.g., N,N-biscarboxymethylhydrazine), phenylsemicarbazides, triethanolamine or catecholsulfonic acids; an organic solvent such as ethylene glycol or diethylene glycol; a development accelerator such as benzyl alcohol, polyethylene glycol, quaternary ammonium salts or amines; a dye-forming coupler; a competing coupler; an auxiliary developing agent such as 1-phenyl-3-pyrazolidone; a tackifier; and various chelating agents such as aminopolycarboxylic acids, aminopolyphosphonic acids, alkylphosphonic acids or phosphonocarboxylic acids. Specific examples of such chelating agents include ethylenediaminetetraacetic acid, nitrilotriacetic acid, diethylenetriaminepentaacetic acid, cyclohexanediamine-tetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid) and salts thereof.

When reversal processing is carried out, the photographic materials are first subjected to black-and-white development, then to reversal processing and thereafter to color development. The black-and-white developer to be used in the black-and-white development may contain known black-and-white developing agents, for example, dihydroxybenzenes such as hydroquinone, 3-pyrazolidones such as 1-phenyl-3-pyrazolidone or aminophenols such as N-methyl-p-aminophenol, singly or in a combination thereof.

The color developer and black-and-white developer generally have a pH value of from 9 to 12. The amount of the replenisher to the developer is, although depending upon the color photographic materials to be processed, generally 3 liters or less per $m^2$ of the material. By lowering the bromide ion concentration in the replenisher, the amount may be 500 ml or lower. When the amount of the replenisher to be added is lowered, it is desired to prevent the evaporation and aerial oxidation of the processing solution by reducing the contact surface area of the processing tank with air. The contact surface area of the processing solution with air in the processing tank is represented by the opening ratio which is defined by the following formula:

$$\text{Opening Ratio} = \frac{\text{Contact Surface Area (cm}^2\text{) of Processing Solution with Air}}{\text{Volume (cm}^3\text{) of Processing Tank}}$$

The above-mentioned opening ratio is preferably 0.1 or less, more preferably from 0.001 to 0.05.

Various means can be employed for the purpose of reducing the opening ratio, which include, for example, provision of a masking substance such as a floating lid on the surface of the processing solution in the processing tank, employment of a mobile lid such as described in Japanese Patent Application No. 62-241342 and employment of a slit-developing method such as described in JP-A-63-216050.

Reduction of the opening ratio is preferably applied to not only the steps of both color development and black-and-white development, but also all the subsequent steps such as the bleaching, bleach-fixation, fixation, rinsing and stabilization steps.

In addition, the amount of the replenisher to be added may also be reduced by means of suppressing accumulation of bromide ions in the developer.

The time for the color development is generally within the range of from 2 minutes to 5 minutes, but the processing time may be shortened by elevating the processing temperature, elevating the pH value of the processing solution and elevating the concentration of the developing agent.

After being color developed, the photographic emulsion layer is generally bleached. Bleaching may be carried out simultaneously with fixation (bleach-fixation) or separately from the latter. In order to accelerate the photographic processing, bleaching may be followed by bleach-fixation. In addition, bleach-fixation in two continuous processing tanks, fixation prior to bleach-fixation or bleach-fixation followed by bleaching, may also be applied to the photographic materials of the present invention, in accordance with the objects. As the bleaching agent can be used, for example, compounds of polyvalent metals such as iron(III). Specific examples of bleaching agents usable in the present invention include organic complexes of iron(III), such as complexes thereof with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid or glycol ether-diaminetetraacetic acid; citric acid, tartaric acid or malic acid. Among them, aminopolycarboxylic acid/iron(III) complexes such as ethylenediaminetetraacetic acid/iron(III) complex are preferred in view of the rapid processability thereof and of the prevention of environmental pollution therewith. The aminopolycarboxylic acid/iron(III) complexes are especially useful both in a bleaching solution and in a bleach-fixing solution. The bleaching solutions or bleach-fixing solutions containing such aminopolycarboxylic acid/iron(III) complexes generally have a pH value of from 4.0 to 8.0, but the solutions may have a lower pH value for rapid processing.

The bleaching solution, the bleach-fixing solution and the prebath thereof may contain a bleaching accelerating agent, if desired. Various bleaching accelerating agents are known, and examples of the agents which are advantageously used in the present invention include the mercapto group or disulfide group-containing compounds described in U.S. Pat. No. 3,893,858, West German Patent 1,290,812, JP-A-53-95630 and *Research Disclosure,* Item 17129 (July, 1978); the thiazolidine derivatives described in JP-A-50-140129; the thiourea derivatives described in U.S. Pat. No. 3,706,561; the iodides described in JP-A-58-16235; the polyoxyethylene compounds described in West German Patent 2,748,430; the polyamine compounds described in JP-B-45-8836; and bromide ion. Among them, the mercapto group or disulfide group-containing compounds are preferred because of the high accelerating effect thereof, and in particular, the compounds described in U.S. Pat. No. 3,893,858, West German Patent 1,290,812 and JP-A-53-95630 are especially preferred. In addition, the compounds described in U.S. Pat. No. 4,552,834 are also preferred. The bleaching acgelerating agents may also be added to the photographic materials. When picture-taking color photographic materials are bleach-fixed, the bleaching accelerating agents are especially effective.

As the fixing agent, there are mentioned thiosulfates, thiocyanates, thioether compounds, thioureas and a large amount of iodides. Among them, thiosulfates are generally used, and in particular, ammonium thiosulfates are most widely used. As the preservative for the bleach-fixing solution, sulfites, bisulfites, sulfinic acids such as p-toluenesulfinic acid, and carbony-bisulfite adducts are preferred.

The silver halide color photographic materials of the present invention are generally rinsed in water and/or stabilized, after being desilvered. The amount of the water to be used in the rinsing step can be set in a broad range, in accordance with the characteristic of the photographic material being processed (for example, depending upon the raw material components, such as the coupler and so on) or the use of the material, as well as the temperature of the rinsing water, the number of the rinsing tanks (the number of the rinsing stages), the replenishment system of normal current or countercurrent and other various kinds of conditions. Among these conditions, the relationship between the number of the rinsing tanks and the amount of the rinsing water in a multi-stage countercurrent rinsing system can be obtained by the method described in *Journal of the Society of Motion Picture and Television Engineers,* Vol. 64, pages 248 to 253 (May, 1955).

According to the multi-stage countercurrent system described in the above-mentioned reference, the amount of the rinsing water to be used can be reduced noticeably, but because of the prolongation of the residence time of the water in the rinsing tank, bacteria would propagate in the tank so that the floating substances generated by the propagation of bacteria would adhere to the surface of the material as it was processed. Accordingly, the above system would often have a problem. In the practice of processing the photographic materials of the present invention, the method of reducing calcium and magnesium ions, which is described in JP-A-62-288838, can extremely effectively be used for overcoming this problem. In addition, the isothiazolone compounds and thiabendazoles described in JP-A-57-8542, chlorine-containing bactericides such as chlorinated sodium isocyanurates, and benzotriazoles and other bactericides described in H. Horiguchi, *Chemistry of Bactericidal and Fungicidal Agents* (1986), *Bactericidal and Fungicidal Techniques to Microorganisms,* edited by Association of Sanitary Technique, Japan (1082), and *Encyclopedia of Bactericidal and Fungicidal Agents,* edited by Nippon Bactericide and Fungicide Association (1988) can also be used.

The pH value of the rinsing water to be used for processing the photographic materials of the present invention is from 4 to 9, preferably from 5 to 8. The temperature of the rinsing water and the rinsing time can also be set variously in accordance with the characteristics of the photographic material being processed as well as the use thereof, and in general, the temperature is from 15° to 45° C. and the time is from 20 seconds to 10 minutes, and preferably the temperature is from 25° to 40° C. and the time is from 30 seconds to 5 minutes. Alternatively, the photographic materials of the present invention may also be processed directly with a stabilizing solution in place of being rinsed with water. For the stabilization, any known methods, such as for example, those described in JP-A-57-8543, JP-A-58-14834 and JP-A-60-220345, can be employed.

In addition, the materials can also be stabilized, following the rinsing step. As one example thereof, there may be mentioned a stabilizing bath containing formaldehyde and a surfactant, which is used as a final bath for picture-taking color photographic materials. The stabilizing bath may also contain various chelating agents and fungicides.

The overflow from the rinsing and/or stabilizing solutions, resulting from the addition of replenishers thereto may be re-used in the other steps such as the previous desilvering step.

The silver halide color photographic materials of the present invention can contain a color developing agent for the purpose of simplifying and accelerating the processing of the materials. For incorporation of color developing agents into the photographic materials, various precursors of the agents are preferably used. For example, there are mentioned the indoaniline compounds described in U.S. Pat. No. 3,342,597, the Schiff base compounds described in U.S. Pat. No. 3,342,599 and *Research Disclosure* Items 14850 and 15159, the aldole compounds described in *Research Disclosure* Item 13924, the metal complexes described in U.S. Pat. No. 3,719,492 and the urethane compounds described in JP-A-53-135628, as the precursors.

The silver halide color photographic materials of the present invention can contain various kinds of 1-phenyl-3-pyrazolidones, if desired, for the purpose of accelerating the color developability thereof. Specific examples of these compounds are described in JP-A-56-64339, JP-A-57-144547 and JP-A-58-115438.

The processing solutions for the photographic materials of the invention are used at 10° C. to 50° C. In general, a processing temperature of from 33° C. to 38° C. is standard, but the temperature may be made higher so as to accelerate the processing or to shorten the processing time, or on the contrary, the temperature may be made lower so as to improve the quality of images formed and to improve the stability of the processing solutions used. For the purpose of economization of silver in the photographic materials, the cobalt intensification or hydrogen peroxide intensification described in West German Patent 2,226,770 and U.S. Pat. No. 3,674,499 may be employed in processing the photographic materials of the present invention.

Next, the present invention will be explained in more detail by way of the following examples, which, however, are not intended to restrict the scope of the present invention.

EXAMPLE 1

A photographic material sample of the present invention (Sample No. 101) was prepared as mentioned below.

A solution comprising 12.3 g of the coupler (7) of the invention, 12.3 ml of dibutyl phthalate and 50 ml of ethyl acetate was heated up to 50° C., and this was added to 100 ml of an aqueous solution containing 15 g of gelatin, 1.0 g of sodium dodecylbenzenesulfonate and 0.5 g of sodium di-2-ethylhexyl-sulfosuccinate and then homogenized with a high-speed stirrer (homogenizer, manufactured by Nippon Seiki Seisakusho Co.) to obtain a fine grains-emulsified dispersion.

The thus prepared emulsified dispersion was blended with a photographic emulsion of silver chlorobromide (silver chloride content: 98 mol %) and the pH value thereof was adjusted to 6.0. The resulting emulsion was then coated on a polyethylene-laminated (both sides) paper support to prepare the photographic material sample of the present invention (Sample No. 101). Sample No. 101 had the layer constitution described below. The composition of each layer of the sample is also as described below. As the gelatin-crosslinking agent was used 1-hydroxy-3,5-dichloro-s-triazine sodium salt.

Support:

-continued

| | |
|---|---|
| Polyethylene-laminated (both sides) paper support | |
| First Layer: | |
| Silver chlorobromide (silver chloride content: 98 mol %) | 1150 mg/m² as Ag |
| Coupler (7) | 1.01 mmol/m² |
| Dibutyl phthalate | 1 ml per g of coupler |
| Gelatin | 1200 mg/m² |
| Second Layer: Ultraviolet Absorbing Layer | |
| Ultraviolet absorbent (*1) | 600 mg/m² |
| Solvent for ultraviolet absorbent (*2) | 300 mg/m² |
| Gelatin | 800 mg/m² |
| Third Layer: Protective Layer | |
| Gelatin | 1000 mg/m² |

The compounds used above are as follows.
(*1): 2-(2-Hydroxy-3-sec-butyl-5-tert-butylphenyl)-benzotriazole
(*2): Dioctyl Sebacate In the same manner as above, other samples Nos. 102 to 106 of the present invention and comparative samples Nos. 107 to 112 were prepared. The comparative couplers and comparative compounds used herein are shown in Table 1 below. In preparing the samples, the content of the coupler of the invention or the comparative coupler (A), (B) or (C) in each sample was the same molar amount per m² as the coupler (7) in the sample No. 101. The amount of the dibutyl phthalate, as the coupler solvent in each sample was 1 ml per g of the coupler therein. The comparative compound (D), (E) or (F) were hardly soluble and thus were dissolved in methanol and added to the emulsion, and the content thereof in each sample was $10^{-5}$ mol/m².

Each of the thus prepared samples was exposed through a sensitometrical optical wedge for continuous gradation and then processed in accordance with the steps described below.

| | | |
|---|---|---|
| 1. Color development | 35° C. | 45 sec |
| 2. Bleach-fixation | 35° C. | 1 min 00 sec |
| 3. Rinsing | 25 to 30° C. | 2 min 30 sec |

The processing solutions used in the above-mentioned processing steps had the following compositions.

Color Developer:

-continued

| | |
|---|---|
| Water | 800 cc |
| Ethylenediaminetetraacetic acid | 1.0 g |
| Sodium sulfite | 0.2 g |
| N,N-diethylhydroxylamine | 4.2 g |
| Potassium bromide | 0.01 g |
| Sodium chloride | 1.5 g |
| Triethanolamine | 8.0 g |
| Potassium carbonate | 30 g |
| N-ethyl-N-(β-methanesulfonamidoethyl)-3-methyl-4-aminoaniline sulfate | 4.5 g |
| 4,4'-Diaminostilbene brightening agent (WHITEX 4, product of Sumitomo Chemical Co.) | 2.0 g |
| Water to make | 1000 ml |
| KOH to make pH of | 10.25 |
| Bleach-fixing Solution: | |
| Ammonium thiosulfate (54 wt % aqueous solution) | 150 ml |
| $Na_2SO_3$ | 15 g |
| $NH_4(Fe(III)(EDTA))$ | 55 g |
| EDTA.2Na | 4 g |
| Glacial acetic acid | 8.61 g |
| Water to make | 1000 ml |
| pH | 5.4 |
| Rinsing Solution: | |
| EDTA.2Na.$2H_2O$ | 0.4 g |
| Water to make | 1000 ml |
| pH | 7 |

Each of the thus developed samples was then tested as mentioned below, for the purpose of examining the heat-fastness of the color image formed therein. Precisely, the developed sample was stored in the dark at 100° C. (less than 50% RH) for 16 days or at 60° C. and 70% RH for 8 weeks. After thus being stored, the degree of the fading of the color image of each sample was measured as a reduction percentage of the density at a point having an initial density of 1.0. The results obtained are shown in Table 1 below. Additionally, the color tone of each of the developed samples is also shown therein.

As is obvious from the results in Table 1, the color image obtained by the use of the comparative coupler (A), (B) and (C}were poor with respect to heat-fastness. Where the comparative compound (D), (E) and (F) were used, no color image was formed. As opposed to the above, all the couplers of the present invention formed color images which had an excellent heat-fastness.

TABLE 1

| A Sample No. | Coupler or dditive in First Layer | Color Tone | Reduction Percentage (5) of Density of Color Image: 100° C. (less than 50% RH) 4 days | 100° C. (less than 50% RH) 16 days | 60° C., 70% RH 4 weeks | 60° C., 70% RH 8 weeks | Remarks |
|---|---|---|---|---|---|---|---|
| 101 | (7) | Magenta | 0 | 1 | 0 | 0 | Invention |
| 102 | (8) | Somewhat reddish magenta | 0 | 2 | 0 | 0 | " |
| 103 | (14) | Magenta | 0 | 0 | 0 | 0 | " |
| 104 | (24) | Somewhat reddish magenta | 0 | 1 | 0 | 0 | " |
| 105 | (26) | Magenta | 1 | 2 | 0 | 1 | " |
| 106 | (10) | Blue | 0 | 1 | 1 | 1 | " |
| 107 | A | Magenta | 12 | 18 | 8 | 16 | Comparison |
| 108 | B | Blue to cyan | 58 | 90 | 13 | 28 | " |
| 109 | C | Blue | 84 | 93 | 48 | 86 | " |
| 110 | D | —* | | | | | " |
| 111 | E | —* | | | | | " |
| 112 | F | —* | | | | | " |

Note:
*No color formed.

The comparative couplers and comparative compounds used above are as follows:

Coupler (A)
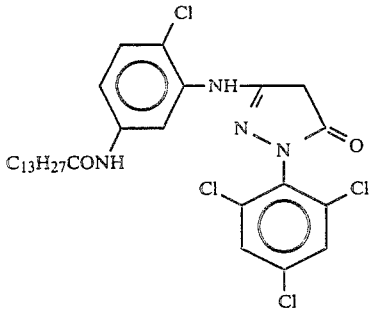
Coupler (B)
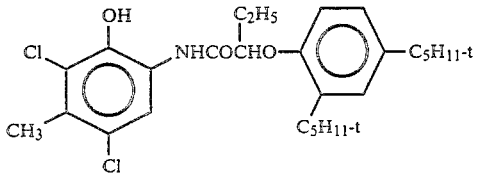
Coupler (C)
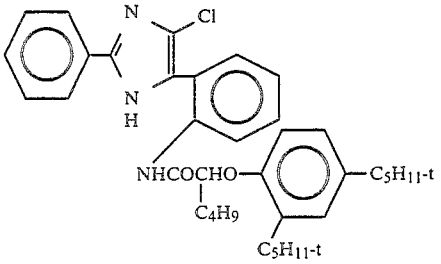
Coupler (2) illustrated in EP 0249453A2
Coupler (D)
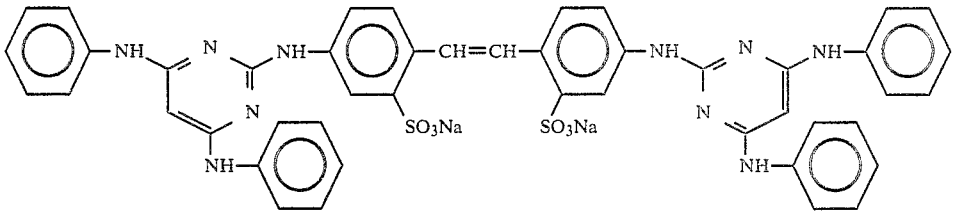
Coupler (II-21) illustrated in JP-B-45-22189
Coupler (E)
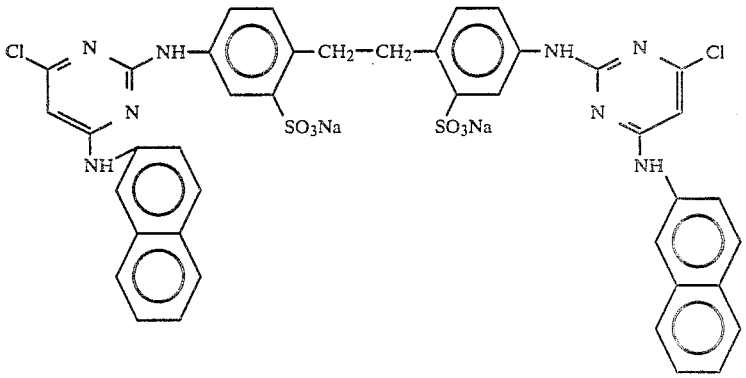
Coupler (IIm) illustrated in JP-B-43-10773

-continued

Coupler (F)

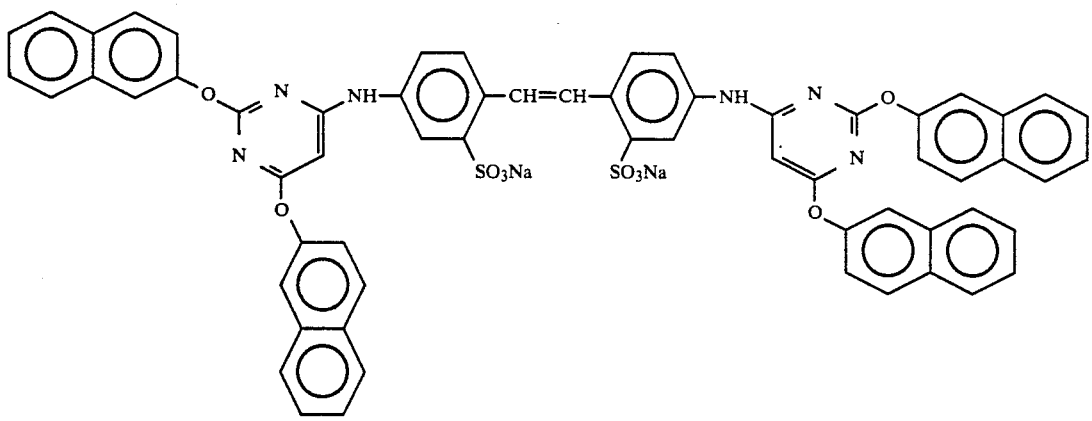

Coupler (I-3) illustrated in JA-62-174738

EXAMPLE 2

Plural layers mentioned below were formed on a polyethylene-laminated (both sides) paper support to prepare a multi-layered color photographic material (Sample No. 201). The coating composition used were prepared as described below.

Preparation of First Layer-Coating Composition 19.1 g of yellow coupler (ExY), 4.4 g of color image stabilizer (Cpd-1) and 0.7 g of color image stabilizer (Cpd-7) were added to 27.2 ml of ethyl acetate and 8.2 g of solvent (Solv-1) and dissolved, and the resulting solution was dispersed by emulsification in 185 ml of aqueous 10% gelatin solution containing 8 ml of 10% sodium dodecylbenzenesulfonate solution. On the other hand, the blue-sensitizing dyes mentioned below were added to silver chlorobromide emulsion's which comprised large cubic grains having a mean grain size of 0.88 micron and small cubic grains having a mean grain size of 0.70 micron in a silver molar ratio of 3/7. The fluctuation coefficients of the grain size distribution were 0.08 for the large grains and 0.10 for the small grains. Both large grains and small grains had 0.2 mol % of silver bromide localized on the surfaces of the grains. The amount of the blue-sensitizing dyes added was individually $2.0\times10^{-4}$ mol per mol of silver to the large grain size emulsion and $2.5\times10^{-4}$ mol per mol of silver to the small grain size emulsion. After addition of the dyes, the emulsions were then sulfur sensitized. The previously prepared emulsified dispersion and the thus sulfur-sensitized emulsion were blended and formed into the first layer-coating liquid having the composition mentioned below.

The other coating liquids for the second layer through the seventh layer were prepared in the same manner as mentioned above. As the gelatin-hardening agent for each layer was used 1-hydroxy-3,5-dichloro-s-triazine sodium salt.

The color-sensitizing dyes used for the respective layers were as follows:

Blue-sensitive Emulsion Layer:

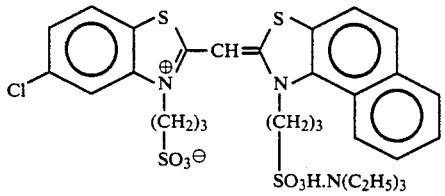

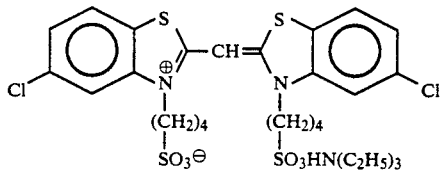

(These were added each in an amount of $2.0\times10^{-4}$ mol per mol of silver halide to the large grain size emulsion and in an amount of $2.5\times10^{-4}$ mol per mol of silver halide to the small grain size emulsion.)

Green-sensitive Emulsion Layer:

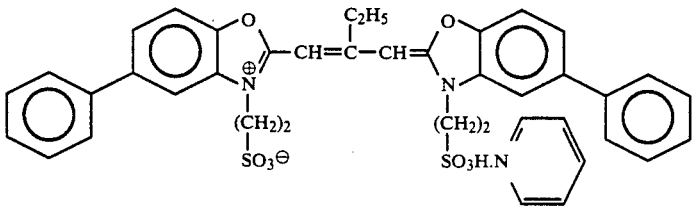

(This was added in an amount of $4.0\times10^{-4}$ mol per mol of silver halide to the large grain size emulsion and in an amount of $5.6\times10^{-4}$ mol per mol of silver halide to the small grain size emulsion.)

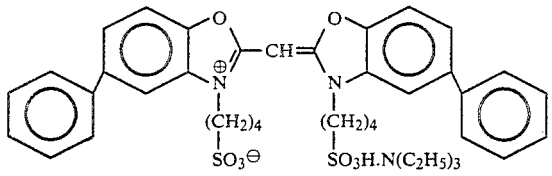

(This was added in an amount of $7.0\times10^{-5}$ mol per mol of silver halide to the large grain size emulsion and in an amount of $1.0\times10^{-5}$ mol per mol of silver halide to the small grain size emulsion.)

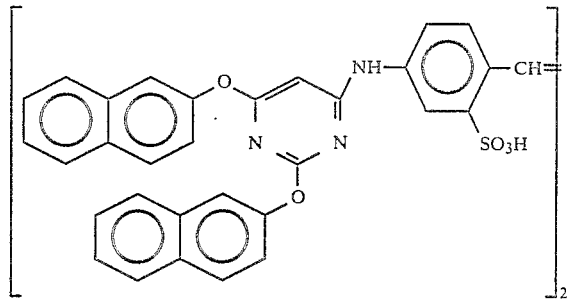

Red-sensitive Emulsion Layer:

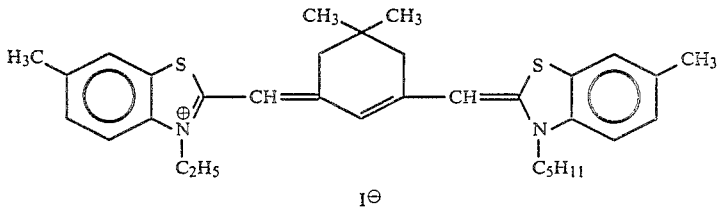

(This was added in an amount of $0.9\times10^{-4}$ mol per mol of silver halide to the large grain size emulsion and in an amount of $1.1\times10^{-4}$ mol per mol of silver halide to the small grain size emulsion.)

Additionally, the following compound was added to the red-sensitive emulsion layer in an amount of $2.6\times10^{-3}$ mol per mol of silver halide.

Further, 1-(5-methylureidophenyl)-5-mercaptotetrazole was added to the blue-sensitive emulsion layer, green-sensitive emulsion layer and red-sensitive emulsion layer in an amount of $8.5\times10^{-5}$ mol, $7.7\times10^{-4}$ mol and $2.5\times10^{-4}$ mol, respectively, per mol of silver halide.

To the blue-sensitive emulsion layer and green-sensitive emulsion layer was added 4-hydroxy-6-methyl-1,3,3a,7-tetraazaindene in an amount of $1\times10^{-4}$ mol and $2\times10^{-4}$ mol, respectively, per mol of silver halide.

The following dyes were added to the emulsion layers for the purpose of anti-irradiation each in an amount of 0.02 g/m$^2$.

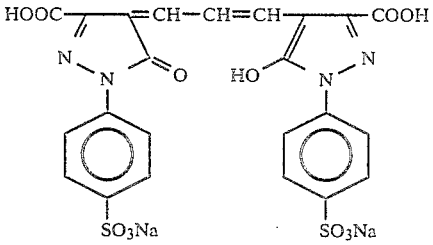

and

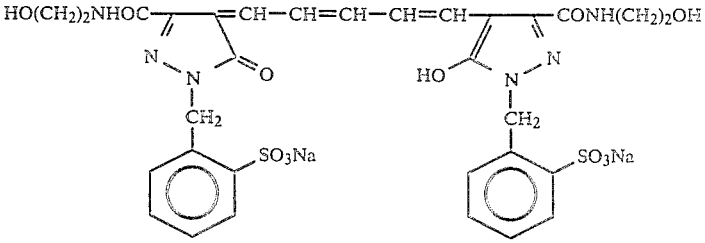

Layer Constitution

Compositions of the respective layers are shown below. The numeral indicates the amount coated as a unit of g/m$^2$. The amount of the silver halide emulsion is represented by the amount of silver as coated.

Support

Polyethylene-laminated Paper (containing white pigment ($TiO_2$) and bluish dye (ultramarine) in the polyethylene of the side of the first layer).

| | |
|---|---|
| First Layer: Blue-sensitive Layer | |
| Above-mentioned silver chlorobromide emulsion | 0.30 |
| Gelatin | 1.86 |
| Yellow coupler (ExY) | 0.82 |
| Color image stabilizer (Cpd-1) | 0.19 |
| Solvent (Solv-1) | 0.35 |
| Color image stabilizer (Cpd-7) | 0.06 |
| Second Layer: Color Mixing Preventing Layer | |
| Gelatin | 0.99 |
| Color mixing preventing agent (Cpd-5) | 0.08 |
| Solvent (Solv-1) | 0.16 |
| Solvent (Solv-4) | 0.08 |
| Third Layer: Green-sensitive Emulsion Layer | |
| Silver chlorobromide emulsion (⅓ (as silver molar ratio) mixture of cubic grains having a mean grain size of 0.55 μm and cubic grains having a mean grain size of 0.39 μm; the former had a fluctuation coefficient of grain size distribution of 0.10 and the latter 0.08; the both had 0.8 mol % of AgBr as localized on the surfaces of the grains) | 0.12 |
| Gelatin | 1.24 |
| Magenta coupler (ExM) | 0.20 |
| Color image stabilizer (Cpd-2) | 0.03 |
| Color image stabilizer (Cpd-3) | 0.15 |
| Color image stabilizer (Cpd-4) | 0.02 |

-continued

| | |
|---|---|
| Color image stabilizer (Cpd-9) | 0.02 |
| Solvent (Solv-2) | 0.40 |
| Fourth Layer: Ultraviolet Absorbing Layer | |
| Gelatin | 1.58 |
| Ultraviolet absorbent (UV-1) | 0.47 |
| Color mixing preventing agent (Cpd-5) | 0.05 |
| Solvent (Solv-5) | 0.24 |
| Fifth Layer: Red-sensitive Layer | |
| Silver chlorobromide emulsion (¼ (as silver molar ratio) mixture of cubic grains having a mean grain size of 0.58 μm and cubic grains having a mean grain size of 0.45 μm; the former had a fluctuation coefficient of grain size distribution of 0.09 and the latter 0.11; the both had 0.6 mol % of AgBr as localized on the surfaces of the grains) | 0.23 |
| Gelatin | 1.34 |
| Cyan coupler (ExC) | 0.32 |
| Color image stabilizer (Cpd-6) | 0.17 |
| Color image stabilizer (Cpd-7) | 0.40 |
| Color image stabilizer (Cpd-8) | 0.04 |
| Solvent (Solv-6) | 0.15 |
| Sixth Layer: Ultraviolet Absorbing Layer | |
| Gelatin | 0.53 |
| Ultraviolet absorbent (UV-1) | 0.16 |
| Color mixing preventing agent (Cpd-5) | 0.02 |
| Solvent (Solv-5) | 0.08 |
| Seventh Layer: Protective Layer | |
| Gelatin | 1.33 |
| Acryl-modified copolymer of polyvinyl alcohol (modification degree: 17%) | 0.17 |
| Liquid paraffin | 0.03 |

The compounds used above are as follows:

(ExY) Yellow Coupler:

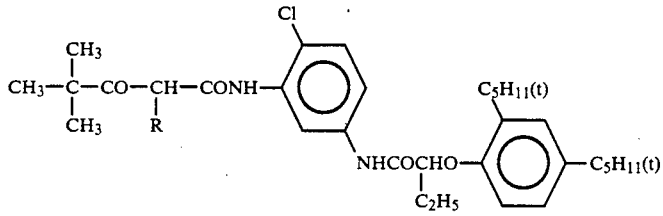

1:1 (by mol) mixture of:

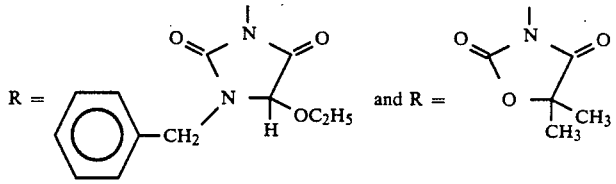

(ExM) Magenta Coupler:

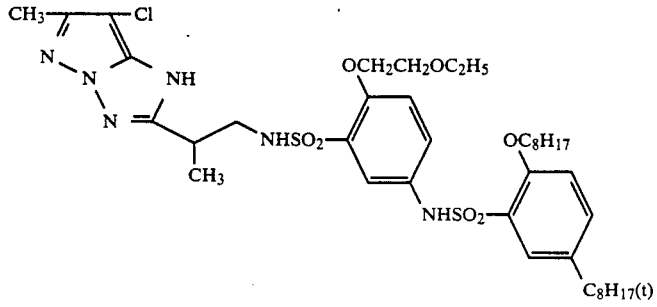

(ExC) Cyan Coupler

2:4:4 (by weight) mixture of:

-continued
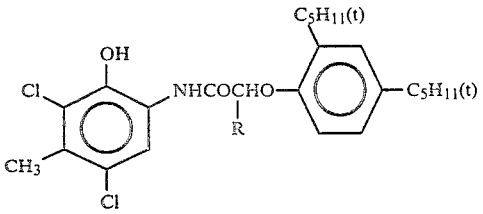
R = $C_2H_5$, $C_4H_9$, and
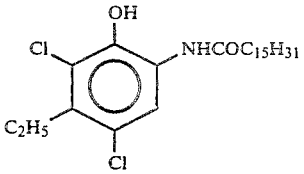
(Cpd-1) Color Image Stabilizer:
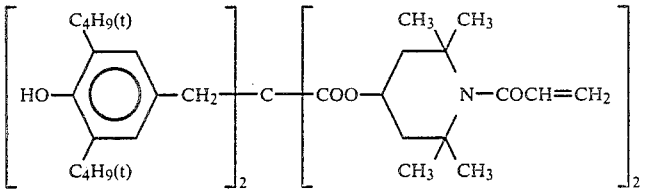
(Cpd-2) Color Image Stabilizer
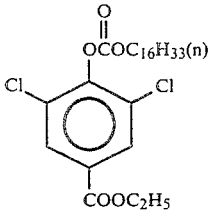
(Cpd-3) Color Image Stabilizer
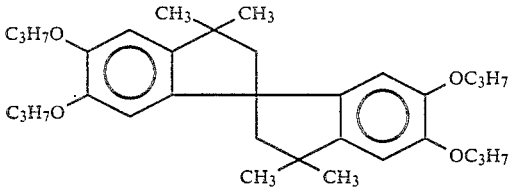
(Cpd-4) Color Image Stabilizer
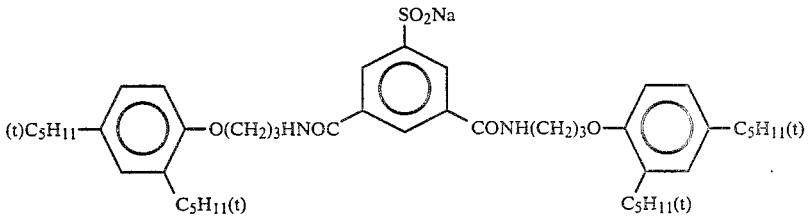
(Cpd-5) Color Mixing Preventing Agent
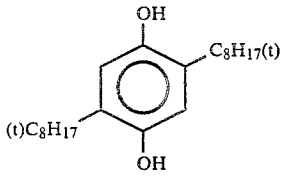
(Cpd-6) Color Image Stabilizer
2:2:4 (by weight) mixture of:

-continued
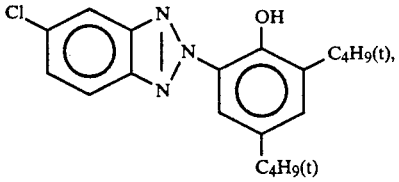
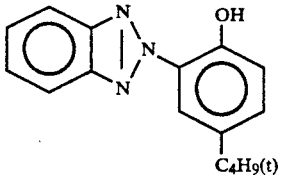
and
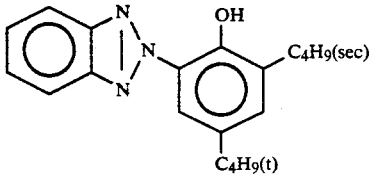
(Cpd-7) Color Image Stabilizer
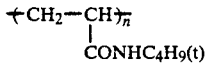
(mean molecular weight 60,000)
(Cpd-8) Color Image Stabilizer
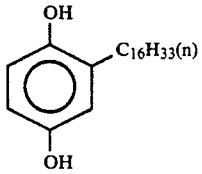
(Cpd-9) Color Image Stabilizer
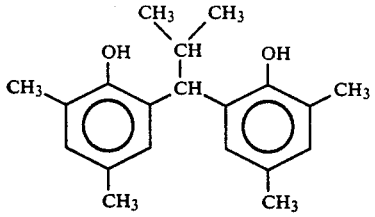
(UV-1) Ultraviolet Absorbent
4:2:4 (by weight) mixture of:
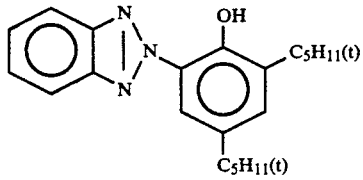
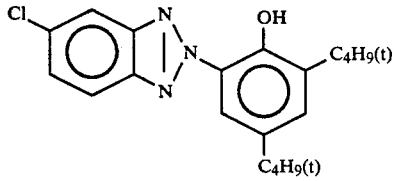
and -continued

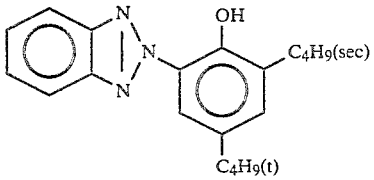

(Solv-1) Solvent:

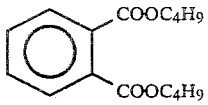

(Solv-2) Solvent

2:1 (by weight) mixture of

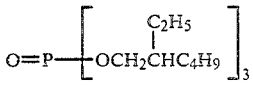

and

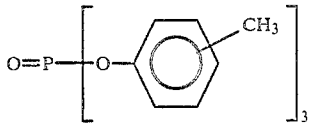

(Solv-4) Solvent:

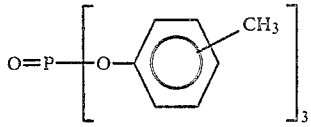

(Solv-5) Solvent

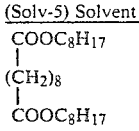

(Solv-6) Solvent

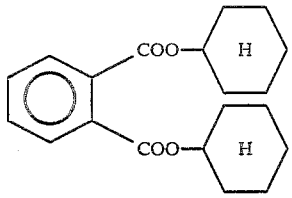

Other samples Nos. 202 to 210 were prepared in the same manner as above, except that the magenta coupler (ExM) in the third layer and the cyan coupler (ExC) in the fifth layer were substituted by the same molar amount of the couplers indicated in Table 2 below.

These samples were exposed through a sensitometrical optical wedge for continuous gradation and then processed in accordance with the processing steps mentioned below. As a result the sample Nos. 202 to 210 of the present invention gave excellent color images all having an excellent heat-fastness.

TABLE 2

| Sample No. | Coupler in 3rd Layer (ExM) | Coupler in 5th Layer (ExC) | Remarks |
|---|---|---|---|
| 201 | ExM | ExC | Out of the invention |
| 202 | (7) | ExC | Invention |

TABLE 2-continued

| Sample No. | Coupler in 3rd Layer (ExM) | Coupler in 5th Layer (ExC) | Remarks |
|---|---|---|---|
| 203 | (8) | ExC | " |
| 204 | (14) | ExC | " |
| 205 | (16) | ExC | " |
| 206 | (22) | ExC | " |
| 207 | (24) | ExC | " |
| 208 | ExM | (10) | " |
| 209 | (7) | (25) | " |
| 210 | (14) | (25) | " |

The processing steps were as follows:

| Processing Steps | Temp. | Time | Re-plenisher* | Tank Capacity |
|---|---|---|---|---|
| Color development | 35° C. | 45 sec | 161 ml | 17 liters |

-continued

| Processing Steps | Temp. | Time | Re-plenisher* | Tank Capacity |
|---|---|---|---|---|
| Bleaching-fixation | 30 to 35° C. | 45 sec | 215 ml | 17 liters |
| Rinsing (1) | 30 to 35° C. | 20 sec | — | 10 liters |
| Rinsing (2) | 30 to 35° C. | 20 sec | — | 10 liters |
| Rinsing (3) | 30 to 35° C. | 20 sec | 350 ml | 10 liters |
| Drying | 70 to 80° C. | 60 sec | | |

*The amount of the replenisher is per $m^2$ of the sample being processed.

Rinsing was effected by three-tank counter-current system from rinsing (3) to rinsing (1).

The processing solutions used in the above-mentioned processing steps had the following compositions.

| | Tank Solution | Replenisher |
|---|---|---|
| Color Developer: | | |
| Water | 800 ml | 800 ml |
| Ethylenediamine-N,N,N,N-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-bis(carboxymethyl)-hydrazine | 5.5 g | 7.0 g |
| Brightening agent (WHITEX 4B, product of Sumitomo Chemical) | 1.0 g | 2.0 g |
| Water to make | 1000 ml | 1000 ml |
| pH (25° C.) | 10.05 | 10.45 |
| Bleach-fixing Solution: | | |
| Tank solution and replenisher were same. | | |
| Water | | 400 ml |
| Ammonium thiosulfate (70% aqueous solution) | | 100 ml |
| Sodium sulfite | | 17 g |
| Ammonium ethylenediamine-tetraacetato/iron(III) | | 55 g |
| Disodium ethylenediaminetetraacetate | | 5 g |
| Ammonium bromide | | 40 g |
| Water to make | | 1000 ml |
| pH (25° C.) | | 6.0 |
| Rinsing Solution: | | |
| Tank solution and replenisher were same. Ion-exchanged Water (having calcium content of 3 ppm or less and magnesium content of 3 ppm or less) | | |

EXAMPLE 3

Plural layers mentioned below were coated on a subbing layer-coated cellulose triacetate film support to prepare a multi-layered color photographic material sample (Sample No. 301). The compositions of the respective layers are described below.

Compositions of Light-Sensitive Layers

The amount coated was represented by the unit of $g/m^2$ as silver for silver halide and colloidal silver. For coupler, additive and gelatin, the amount coated was represented by the unit of $g/m^2$. For the sensitizing dye, the amount coated was represented by the unit of the number of mols per mol of the silver halide in the same layer.

| | |
|---|---|
| First Layer: Anti-halation Layer | |
| Black colloidal silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |
| Second Layer: Interlayer | |
| Gelatin | 1.0 |
| UV-1 | 0.03 |
| ExC-4 | 0.02 |
| ExF-1 | 0.004 |
| Solv-1 | 0.1 |
| Solv-2 | 0.1 |
| Third Layer: Low-sensitive Red-sensitive Emulsion Layer | |
| Silver iodobromide emulsion (AgI 4 mol %; uniform AgI type grains; sphere-corresponding diameter 0.5 μm; fluctuation coefficient of sphere-corresponding diameter 20%; tabular grains having ratio of diameter/thickness of 3.0) | 1.2 as Ag |
| Silver iodobromide emulsion (AgI 3 mol %; uniform AgI type grains; sphere-corresponding diameter 0.3 μm; fluctuation coefficient of sphere-corresponding diameter 15%; spherical grains having ratio of diameter/thickness of 1.0) | 0.6 as Ag |
| Gelatin | 1.0 |
| ExS-1 | $4 \times 10^{-4}$ |
| ExS-2 | $5 \times 10^{-5}$ |
| ExC-1 | 0.05 |
| ExC-2 | 0.50 |
| ExC-3 | 0.03 |
| ExC-4 | 0.12 |
| ExC-5 | 0.01 |
| ExC-8 | 0.03 |
| Fourth Layer: High-sensitive Red-sensitive Emulsion Layer | |
| Silver iodobromide emulsion (AgI 6 mol %; interior AgI-rich core/shell (1/1) grains; sphere-corresponding diameter 0.7 μm; fluctuation coefficient of sphere-corresponding diameter 15%; tabular grains with ratio of diameter/thickness of 5.0) | 0.7 as Ag |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| Fifth Layer: Interlayer | |
| Gelatin | 0.05 |
| Cpd-1 | 0.1 |
| Cpd-7 | 0.05 |
| Solv-1 | 0.05 |
| Sixth Layer: Low-sensitive Green-sensitive Emulsion Layer | |
| Silver iodobromide emulsion (AgI 4 mol %; interior AgI-rich core/shell (1/1) grains; sphere-corresponding diameter 0.5 μm; fluctuation coefficient of sphere-corresponding diameter 15%; tabular grains with ratio of diameter/thickness of 4.0) | 0.35 as Ag |
| Silver iodobromide emulsion (AgI 3 mol %; uniform AgI grains; sphere-corresponding diameter 0.3 μm; fluctuation coefficient of sphere-corresponding diameter 25%; spherical grains with ratio of diameter/thickness of 1.0) | 0.20 as Ag |

-continued

| | |
|---|---|
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |
| Seventh Layer: High-sensitive Green-sensitive Emulsion Layer | |
| Silver iodobromide emulsion (AgI 4 mol %; interior AgI-rich core/shell (½) grains; sphere-corresponding diameter 0.7 μm; fluctuation coefficient of sphere-corresponding diameter 20%; tabular grains with ratio of diameter/thickness of 5.0) | 0.8 as Ag |
| Gelatin | 0.5 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.04 |
| Solv-1 | 0.2 |
| Solv-4 | 0.01 |
| Eighth Layer: Interlayer | |
| Gelatin | 0.5 |
| Cpd-1 | 0.05 |
| Solv-1 | 0.02 |
| Ninth Layer: Interlayer Effect Donor Layer to Red-sensitive Layer | |
| Silver iodobromide emulsion (AgI 2 mol %; interior AgI-rich core/shell (2/1) grains; sphere-corresponding diameter 1.0 μm micron; fluctuation coefficient of sphere-corresponding diameter 15%; tabular grains with ratio of diameter/thickness of 6.0) | 0.35 as Ag |
| Silver iodobromide emulsion (AgI 2 mol %; interior AgI-rich core/shell (1/1) grains; sphere-corresponding diameter 0.4 μm; fluctuation coefficient of sphere-corresponding diameter 20%; tabular grains with ratio of diameter/thickness of 6.0) | 0.20 as Ag |
| Gelatin | 0.5 |
| ExS-3 | $8 \times 10^{-4}$ |
| ExY-11 | 0.11 |
| ExM-12 | 0.03 |
| ExM 14 | 0.10 |
| Solv-1 | 0.20 |
| Tenth Layer: Yellow Filter Layer | |
| Yellow colloidal silver | 0.05 |
| Gelatin | 0.5 |
| Cpd-2 | 0.13 |
| Solv-1 | 0.13 |

-continued

| | |
|---|---|
| Cpd-1 | 0.10 |
| Eleventh Layer: Low-sensitive Blue-sensitive Emulsion Layer | |
| Silver iodobromide emulsion (AgI 4.5 mol %; uniform AgI grains; sphere-corresponding diameter 0.7 μm; fluctuation coefficient of sphere-corresponding diameter 15%; tabular grains with ratio of diameter/thickness of 7.0) | 0.3 as Ag |
| Silver iodobromide emulsion (AgI 3 mol %; uniform AgI grains; sphere-corresponding diameter 0.3 μm; fluctuation coefficient of sphere-corresponding diameter 25%; tabular grains with ratio of diameter/thickness of 7.0) | 0.15 as Ag |
| Gelatin | 1.6 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 1.0 |
| Solv-1 | 0.20 |
| Twelfth Layer: High-sensitive Blue-sensitive Emulsion Layer | |
| Silver iodobromide emulsion (AgI 10 mol %; interior AgI-rich grains; sphere-corresponding diameter 1.0 μm micron; fluctuation coefficient of sphere-corresponding diameter 25%; multi-layered twin tabular grains with ratio of diameter/thickness of 2.0) | 0.20 as Ag |
| Gelatin | 0.5 |
| ExS-6 | $1 \times 10^{-4}$ |
| ExY-15 | 0.20 |
| ExU-13 | 0.01 |
| Solv-1 | 0.10 |
| Thirteenth Layer: First Protective Layer | |
| Gelatin | 0.8 |
| UV-4 | 0.1 |
| UV-5 | 0.15 |
| Solv-1 | 0.01 |
| Solv-2 | 0.01 |
| Fourteenth Layer: Second Protective Layer | |
| Fine silver iodobromide grain-containing emulsion (AgI 2 mol %; uniform AgI type grains; sphere-corresponding diameter 0.07 μm) | 0.5 |
| Gelatin | 0.45 |
| Polymethyl methacrylate grains (diameter 1.5 μm) | 0.2 |
| H-1 | 0.4 |
| Cpd-5 | 0.5 |
| Cpd-6 | 0.5 |
| Cpd-8 | 0.2 |

Each layer contained emulsion stabilizer (Cpd-3) (0.04 g/m$^2$) and surfactant (Cpd-4) (0.02 g/m$^2$) as coating aids, in addition to the above-mentioned components.

The compounds used above are as follows:

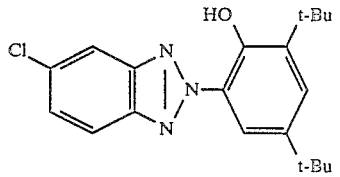

UV-1

-continued
UV-2
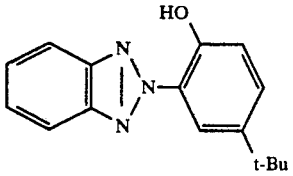
UV-3
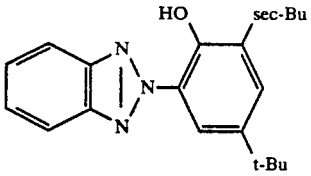
UV-4
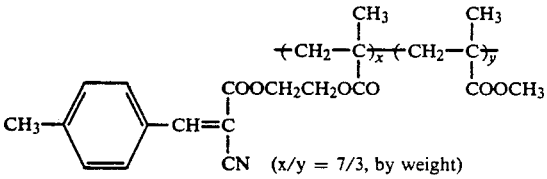
(x/y = 7/3, by weight)
UV-5
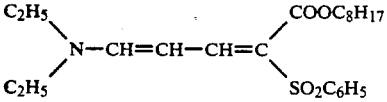
Tricresyl Phosphate — Solv-1
Dibutyl Phthalate — Solv-2
Solv-3
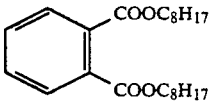
Solv-4
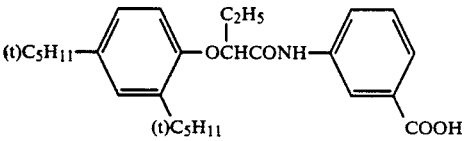
Cpd-1
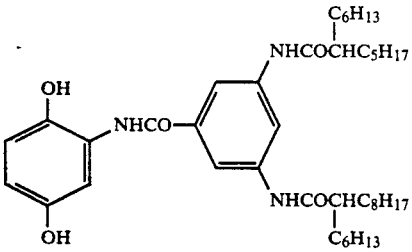
Cpd-2
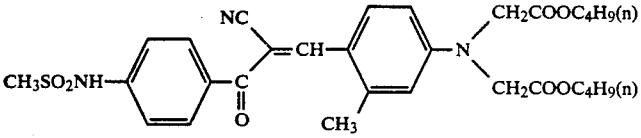
Cpd-7
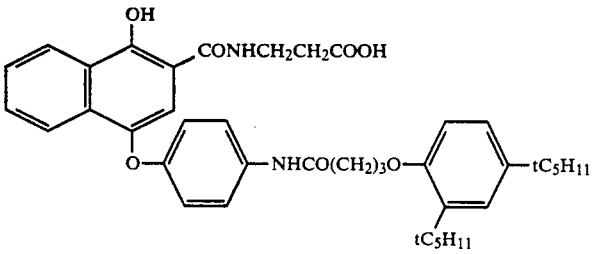

-continued
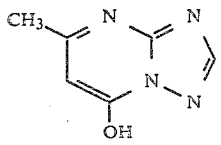
Cpd-3
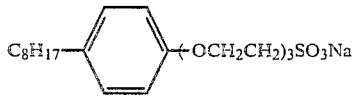
Cpd-4
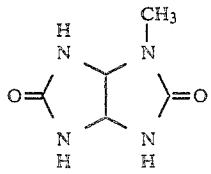
Cpd-5
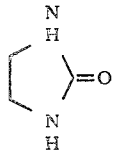
Cpd-6
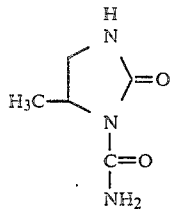
Cpd-8
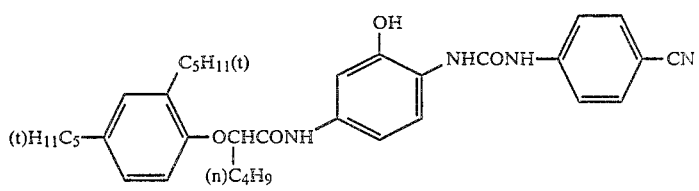
ExC-1
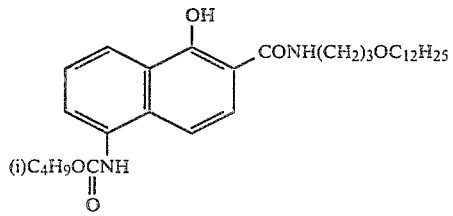
ExC-2

-continued
ExC-3
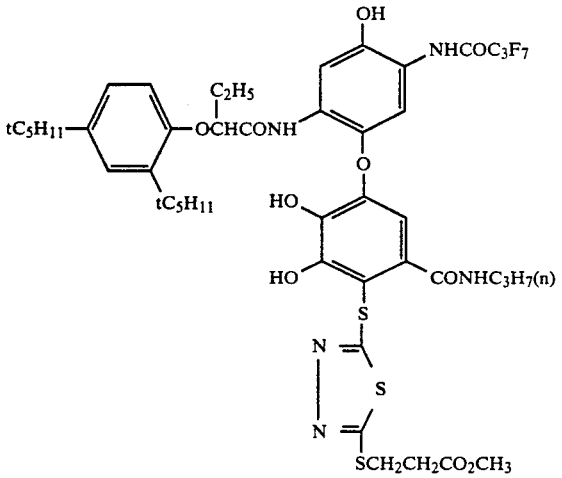
ExC-4
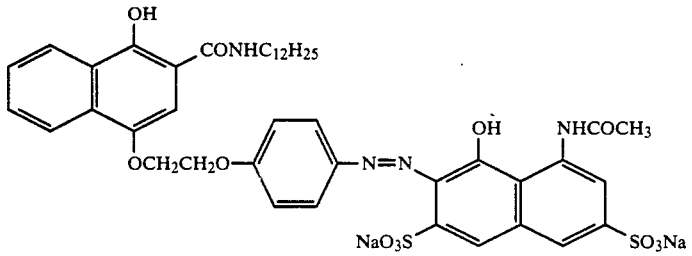
ExC-8
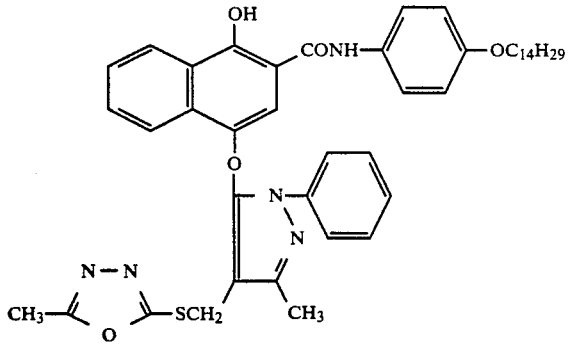
ExC-5
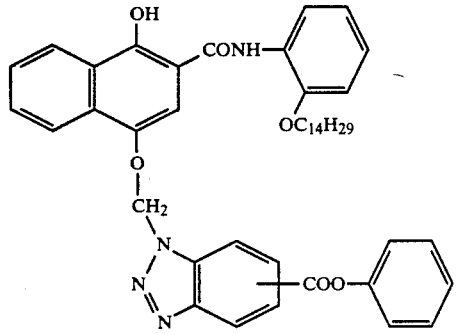

-continued
ExC-6
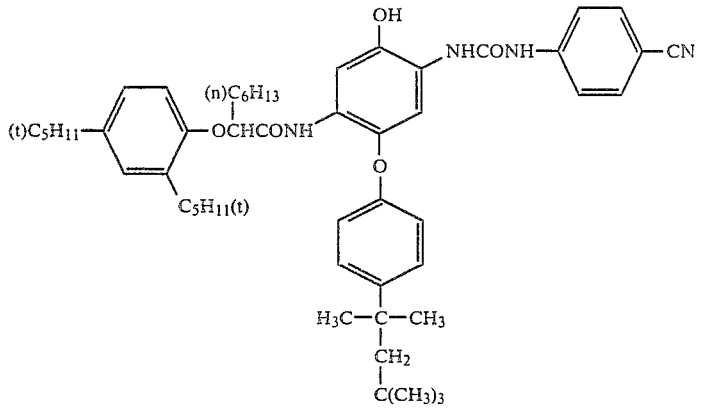
ExC-7
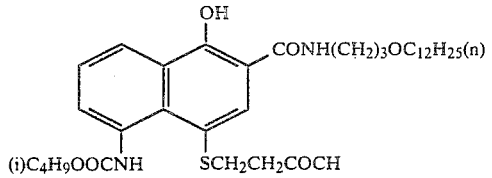
ExM-8
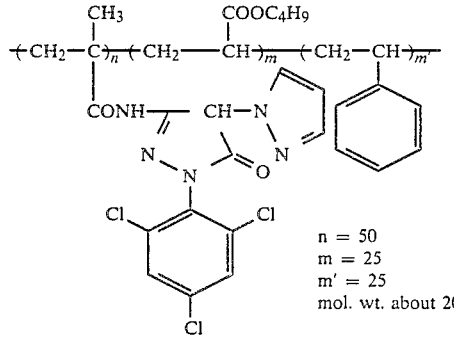
n = 50
m = 25
m' = 25
mol. wt. about 20,000
ExM-9
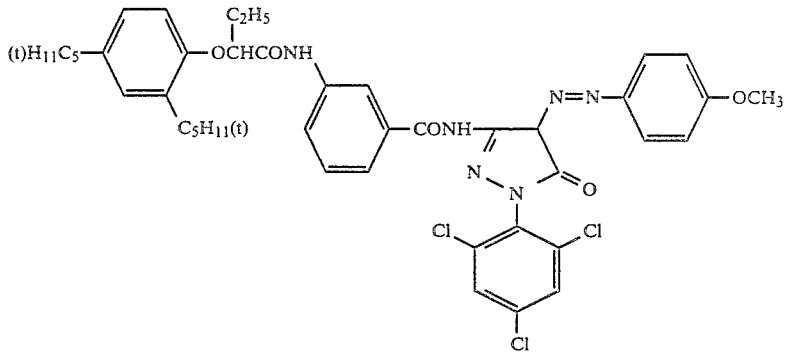
ExM-10
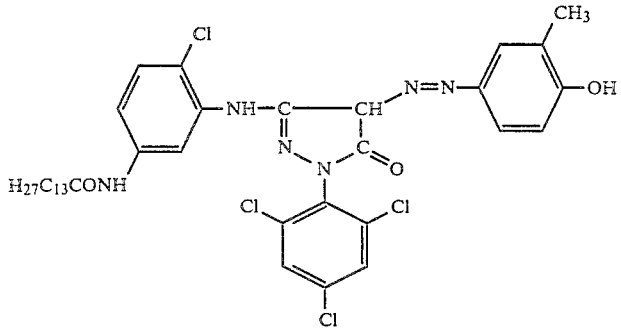

-continued
ExY-11
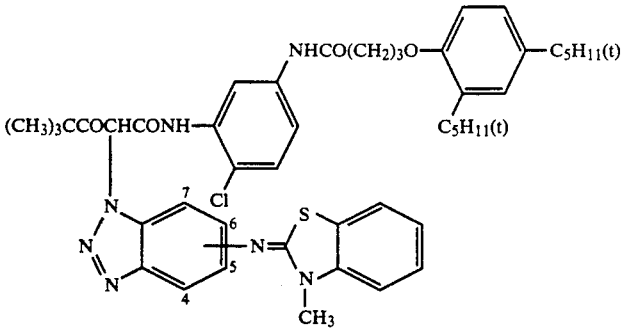
(A mixture of 5- or 6-substituted compounds)
ExM-12
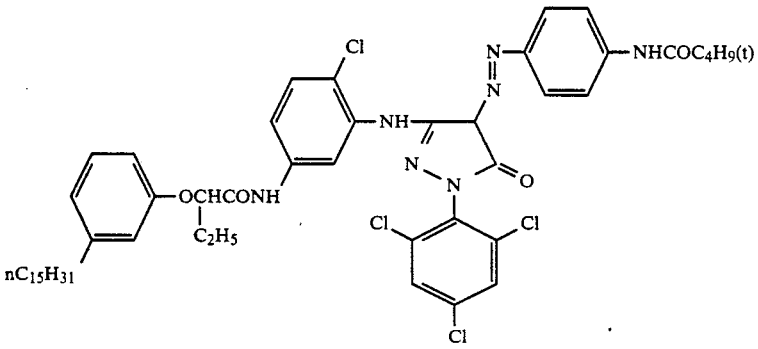
ExY-13
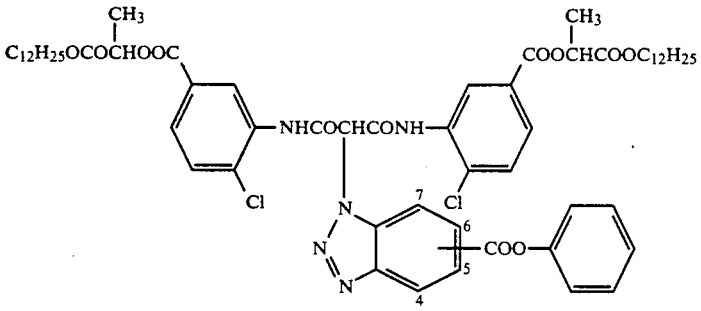
(A mixture of 5- or 6-substituted compounds)
ExM-14
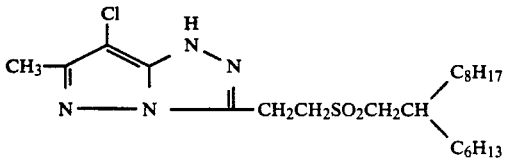
ExY-15
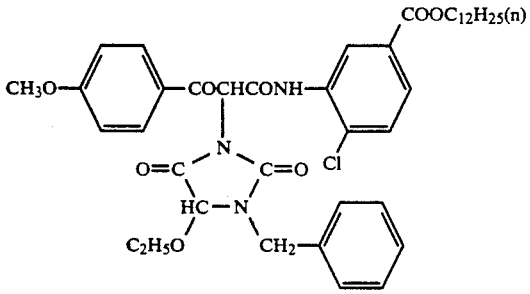

-continued
ExC-16
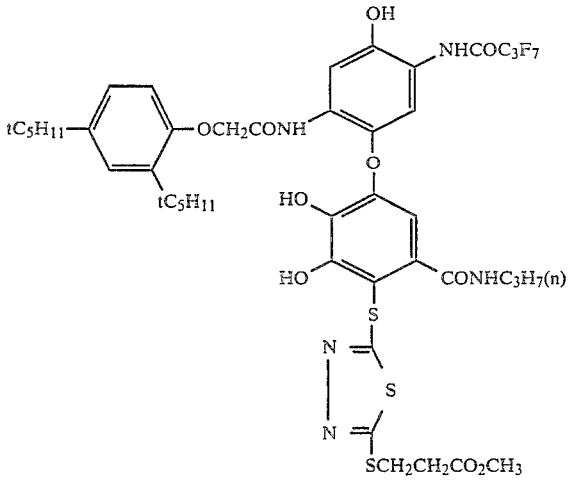
ExS-1
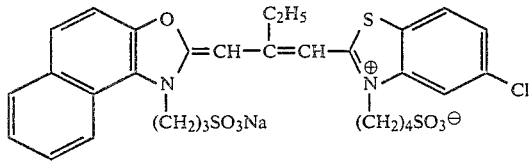
ExS-2
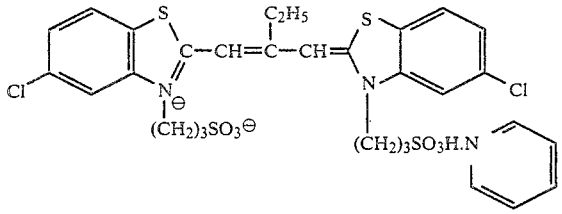
ExS-3
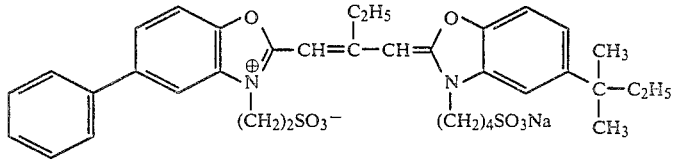
ExS-4
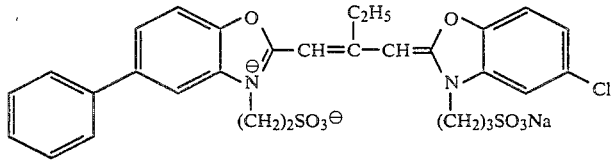
ExS-5
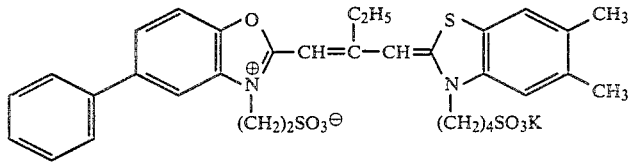
ExS-6
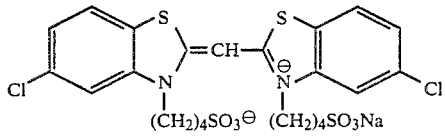
H-1
$CH_2{=}CH{-}SO_2{-}CH_2{-}CONH{-}CH_2$
$CH_2{=}CH{-}SO_2{-}CH_2{-}CONH{-}CH_2$ -continued ExF-1

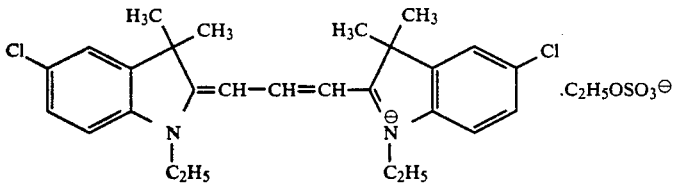

Other samples Nos. 302 to 308 were prepared in the same manner as above, except that the cyan coupler ExC-2 in the third layer and the magenta coupler ExM-8 in the sixth layer were substituted by the same molar amount of the couplers indicated in Table 3 below.

These samples were exposed through a sensitometrical optical wedge for continuous gradation and then processed in accordance with the processing steps mentioned below. As a result, the samples Nos. 302 to of the present invention gave excellent color images all having an excellent heat-fastness.

TABLE 3

| Sample No. | Cyan Coupler in 3rd Layer | Magenta Coupler in 6th Layer | Remarks |
|---|---|---|---|
| 301 | ExC-2 | ExM-8 | Out of the invention |
| 302 | ExC-2 | (5) | Invention |
| 303 | ExC-2 | (7) | " |
| 304 | ExC-2 | (16) | " |
| 305 | ExC-2 | (24) | " |
| 306 | (10) | ExM-8 | " |
| 307 | (10) | (7) | " |
| 308 | (25) | (16) | " |

The processing steps were as follows.

| Processing Steps | Time | Temp. | Replenisher | Tank Capacity |
|---|---|---|---|---|
| Color Development | 2 min 30 sec | 40° C. | 10 ml | 8 liters |
| Bleaching-fixation | 3 min 00 sec | 40° C. | 20 ml | 8 liters |
| Rinsing (1) | 20 sec | 35° C. | (counter-current system from (2) to (1)) | 2 liters |
| Rinsing (2) | 20 sec | 35° C. | 10 ml | 2 liters |
| Stabilization | 20 sec | 35° C. | 10 ml | 2 liters |
| Drying | 50 sec | 65° C. | | |

(The amount of the replenisher is per $m^2$ of the sample being processed.)

The processing solutions used in the above-mentioned processing steps had the following compositions.

| | Mother Solution (g) | Replenisher (g) |
|---|---|---|
| Color Developer: | | |
| Diethylenetriaminepenta-acetic acid | 2.0 | 2.2 |
| 1-Hydroxyethylidene-1,1-diphosphonic acid | 3.0 | 3.2 |
| Sodium sulfite | 4.0 | 5.5 |
| Potassium carbonate | 30.0 | 45.0 |
| Potassium bromide | 1.4 | — |
| Potassium iodide | 1.5 mg | — |
| Hydroxylamine sulfate | 2.4 | 3.0 |
| 4-(N-ethyl-N-β-hydroxyethyl-amino)-2-methylaniline sulfate | 4.5 | 7.5 |

-continued

| | | |
|---|---|---|
| Water to make | 1.0 l | 1.0 l |
| pH | 10.05 | 10.20 |
| Bleach-fixing Solution: | | |
| Mother solution and replenisher were same. The unit of the amount of each constitutive component is g (gram). | | |
| Ammonium ethylenediaminetetra-acetato/iron(III) dihydrate | 90.0 | |
| Disodium ethylenediaminetetraacetate | 5.0 | |
| Sodium sulfite | 12.0 | |
| Ammonium thiosulfate (70% aqueous solution) | 260.0 ml | |
| Acetic acid(98%) | 5.0 ml | |
| Bleaching accelerator | 0.01 mol | |

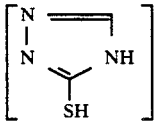

| | | |
|---|---|---|
| Water to make | 1.0 l | |
| pH | 6.0 | |
| Rinsing Solution: | | |
| Mother solution and replenisher were same. | | |

Rinsing Solution

Mother solution and replenisher were same.

A city water was passed through a mixed bed column filled with H-type strong acidic cation-exchange resin (Amberlite IR-120B, manufactured by Rhom and Haas Co.) and OH-type anion-exchange resin (Amberlite IR-400 manufactured by Rhom and Haas Co.) thereby to reduce the calcium ion concentration and the magnesium ion concentration each to 3 mg/liter or less, and subsequently, 20 mg/liter of sodium dichloroisocyanurate and 0.15 g/liter of sodium sulfate were added to the resulting water. This had a pH value of falling within the range of from 6.5 to 7.5.

Stabilizing Solution

Mother solution and replenisher were same. The unit of the amount of each constitutive component is g (gram).

| | |
|---|---|
| Formalin (37%) | 2.0 ml |
| Polyoxyethylene-p-monononylphenyl ether (mean polymerization degree 10) | 0.3 |
| Disodium ethylenediaminetetraacetate | 0.05 |
| Water to make | 1.0 l |
| pH | 5.0 to 8.0 |

EXAMPLE 4

Preparation of Sample No. 401

Plural layers each having the composition mentioned below were formed on a subbing layer-coated cellulose triacetate having a thickness of 127 μm, and a multi-layered color photographic material sample (Sample No.

401) was prepared. The amount of each constitutive component is per $m^2$.

| | |
|---|---|
| **First Layer: Anti-halation Layer** | |
| Black colloidal silver | 0.25 g |
| Gelatin | 1.9 g |
| U-1 | 0.04 g |
| U-2 | 0.1 g |
| U-3 | 0.1 g |
| Oil-1 | 0.1 g |
| **Second Layer: Interlayer** | |
| Gelatin | 0.40 g |
| Cpd-D | 10 mg |
| Oil-3 | 40 mg |
| **Third Layer: Interlayer** | |
| Fogged fine silver iodobromide grains-containing emulsion (mean grain size 0.06 micron; AgI content 1 mol %) | 0.05 g as Ag |
| Gelatin | 0.4 g |
| **Fourth Layer: Low-sensitive Red-sensitive Emulsion Layer** | |
| Silver iodobromide emulsion spectrally sensitized with sensitizing dyes S-1 and S-2 (1/1 (as silver molar ratio) mixture of monodispersed cubic grains having mean grain size of 0.4 μm and AgI content of 4.5 mol % and monodispersed cubic grains having mean grain size of 0.3 μm and AgI content of 4.5 mol %) | 0.4 g as Ag |
| Gelatin | 0.8 g |
| Coupler C-1 | 0.20 g |
| Coupler C-9 | 0.05 g |
| Oil-1 | 0.1 ml |
| **Fifth Layer: Middle-sensitive Red-sensitive Emulsion** | |
| Silver iodobromide emulsion spectrally sensitized with sensitizing as Ag dyes S-1 and S-2 (monodispersed cubic grains having mean grain size of 0.5 μm and AgI content of 4 mol %) | 0.4 g |
| Gelatin | 0.8 g |
| Coupler C-1 | 0.2 g |
| Coupler C-2 | 0.05 g |
| Coupler C-3 | 0.2 g |
| Oil-1 | 0.1 ml |
| **Sixth Layer: High-sensitive Red-sensitive Emulsion Layer** | |
| Silver iodobromide emulsion spectrally sensitized with sensitizing dyes S-1 and S-2 (monodispersed twin crystal grains having mean grain size of 0.7 μm and AgI content of 2 mol %) | 0.4 g as Ag |
| Gelatin | 1.1 g |
| Coupler C-3 | 0.7 g |
| Coupler C-1 | 0.3 g |
| **Seventh Layer: Interlayer** | |
| Gelatin | 0.6 g |
| Dye D-1 | 0.02 g |
| **Eighth Layer: Interlayer** | |
| Fogged silver iodobromide emulsion (mean grain size 0.06 μm, AgI content 0.3 mol %) | 0.05 g |
| Gelatin | 1.0 g |
| Cpd-A | 0.2 g |
| **Ninth Layer: Low-sensitive Green-sensitive Emulsion Layer** | |
| Silver iodobromide emulsion spectrally sensitized with sensitizing dyes S-3 and S-4 (1/1 (as silver molar ratio) mixture of monodispersed cubic grains having mean grain size of 0.4 μm and AgI content of 4.5 mol % and monodispersed cubic grains having mean grain size of 0.2 μm and AgI content of 4.5 mol %) | 0.5 g as Ag |
| Gelatin | 0.5 g |
| Coupler C-4 | 0.10 g |
| Coupler C-7 | 0.10 g |
| Coupler C-8 | 0.10 g |
| Cpd-B | 0.03 g |
| Cpd-E | 0.1 g |
| Cpd-F | 0.1 g |
| Cpd-G | 0.1 g |
| Cpd-H | 0.1 g |
| Oil | 0.1 g |
| **Tenth Layer: Middle-sensitive Green-sensitive Emulsion Layer** | |
| Silver iodobromide emulsion spectrally sensitized with sensitizing dyes S-3 and S-4 (monodispersed cubic grains having mean grain size of 0.5 μm and AgI content of 3 mol %) | 0.4 g as Ag |
| Gelatin | 0.6 g |
| Coupler C-4 | 0.1 g |
| Coupler C-7 | 0.1 g |
| Coupler C-8 | 0.1 g |
| Cpd-B | 0.03 g |
| Cpd-E | 0.1 g |
| Cpd-F | 0.1 g |
| Cpd-G | 0.05 g |
| Cpd-H | 0.05 g |
| Oil-2 | 0.01 g |
| **Eleventh Layer: High-sensitive Green-sensitive Emulsion Layer** | |
| Silver iodobromide emulsion spectrally sensitized with sensitizing dyes S-3 and S-4 (monodispersed tabular grains having mean grain size of 0.6 μm as sphere-corresponding diameter, AgI content of 4.0 mol % and mean value of ratio of diameter/thickness of 7) | 0.5 g as Ag |
| Gelatin | 1.0 g |
| Coupler C-4 | 0.4 g |
| Coupler C-7 | 0.2 g |
| Coupler C-8 | 0.2 g |
| Cpd-B | 0.08 g |
| Cpd-E | 0.1 g |
| Cpd-F | 0.1 g |
| Cpd-G | 0.1 g |
| Cpd-H | 0.1 g |
| Oil-2 | 0.1 g |
| **Twelfth Layer: Interlayer** | |
| Gelatin | 0.6 g |
| Dye D-2 | 0.05 g |
| **Thirteenth Layer: Yellow Filter Layer** | |
| Yellow colloidal silver | 0.1 g as Ag |
| Gelatin | 1.1 g |
| Cpd-A | 0.01 g |
| **Fourteenth Layer: Interlayer** | |
| Gelatin | 0.6 g |
| **Fifteenth Layer: Low-sensitive Blue-sensitive Emulsion Layer** | |
| Silver iodobromide emulsion spectrally sensitized with sensitizing dyes S-5 and S-6 (1/1 (as silver molar ratio) mixture of monodispersed cubic grains having mean grain size of 0.4 μm and AgI content of 3 mol % and monodispersed cubic grains having mean grain size of 0.2 μm and AgI content of 3 mol %) | 0.6 g as Ag |
| Gelatin | 0.8 g |
| Coupler C-5 | 0.6 g |
| **Sixteenth Layer: Middle-sensitive Blue-sensitive Emulsion Layer** | |
| Silver iodobromide emulsion spectrally sensitized with sensitizing dyes S-5 and S-6 (monodispersed cubic grains having mean grain size of 0.5 μm and AgI content of 2 mol %) | 0.4 g as Ag |
| Gelatin | 0.9 g |
| Coupler C-5 | 0.3 g |
| Coupler C-6 | 0.3 g |
| **Seventeenth Layer: High-sensitive Blue-sensitive Emulsion Layer** | |
| Silver iodobromide emulsion spectrally sensitized with sensitizing dyes S-5 and S-6 (tabular grains having mean grain size of 0.7 μm as sphere-corresponding diameter, AgI content of 1.5 mol % and mean ratio of diameter/thickness of 7) | 0.4 g as Ag |
| Gelatin | 1.2 g |
| Coupler C-6 | 0.7 g |
| **Eighteenth Layer: First Protective Layer** | |
| Gelatin | 0.7 g |
| U-1 | 0.04 g |
| U-3 | 0.03 g |
| U-4 | 0.03 g |
| U-5 | 0.05 g |
| U-6 | 0.05 g |
| Cpd-C | 0.8 g |

-continued

| | |
|---|---|
| Dye D-3 | 0.05 g |
| Nineteenth Layer: Second Protective Layer | |
| Fogged fine silver iodobromide grains-containing emulsion (mean grain size 0.06 μm, AgI content 1 mol %) | 0.1 g as Ag |
| Gelatin | 0.4 g |
| Twentieth Layer: Third Protective Layer | |
| Gelatin | 0.4 g |
| Polymethyl methacrylate (mean grain size 1.5 microns) | 0.1 g |

-continued

| | |
|---|---|
| Methyl methacrylate/acrylic acid (4/6) copolymer (mean grain size 1.5 microns) | 0.1 g |
| Silicone oil | 0.03 g |
| Surfactant W-1 | 3.0 mg |

Each layer contained gelatin hardening agent H-1 and coating and emulsifying surfactant, in addition to the above-mentioned components.

The compounds used above are as follows.

C-1

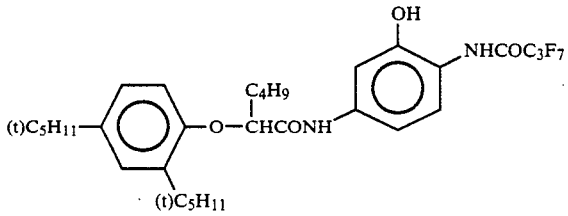

C-2

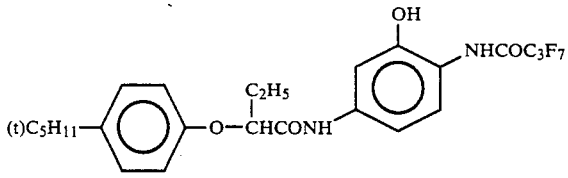

C-3

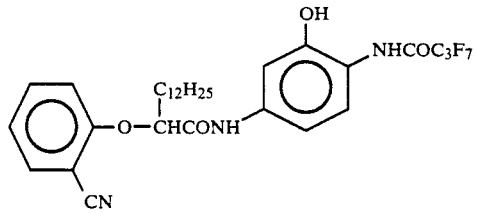

C-4

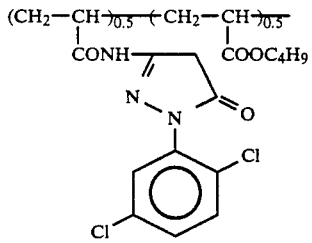

(Suffixes of parenthesis show weight ratio)

C-5

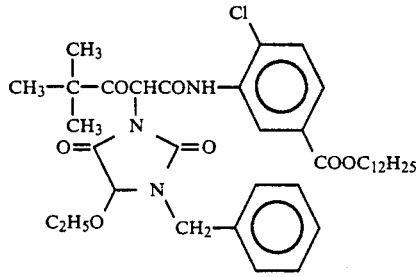

-continued
C-6
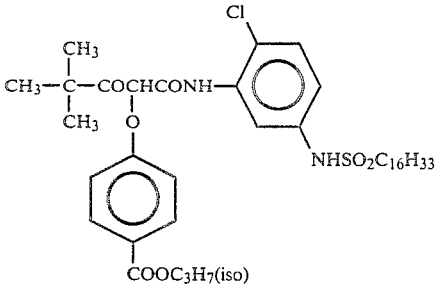
C-7
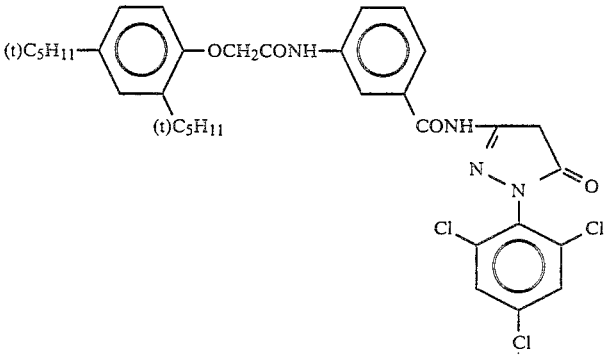
C-8
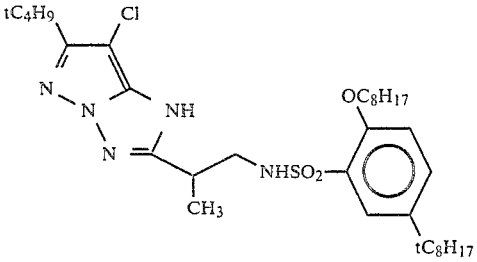
C-9
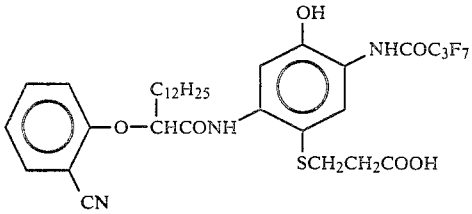
Dibutyl Phthalate — Oil-1
Tricresyl Phosphate — Oil-2
Oil-3
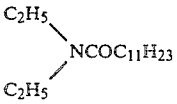
Cpd-A
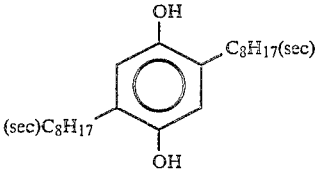
Cpd-B
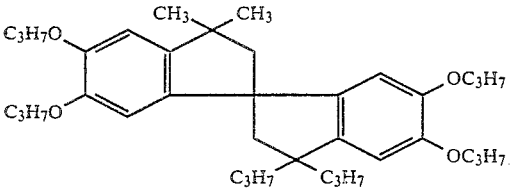

-continued
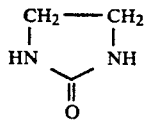
Cpd-C
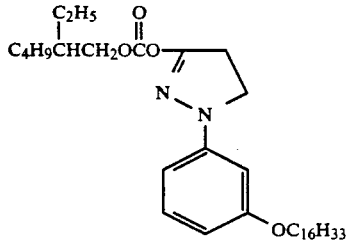
Cpd E
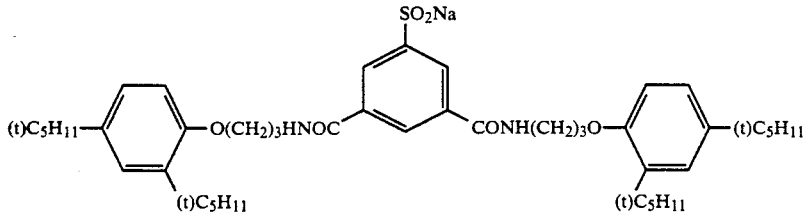
Cpd F
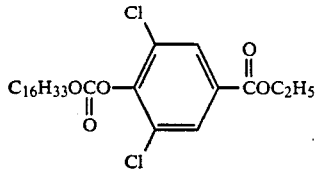
Cpd G
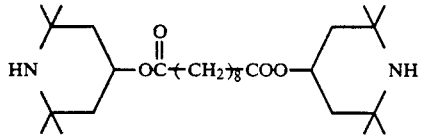
Cpd H
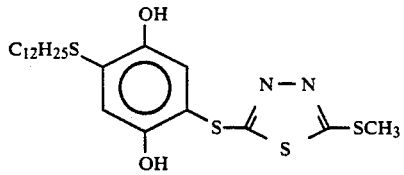
Cpd-D
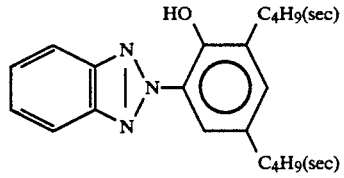
U-1
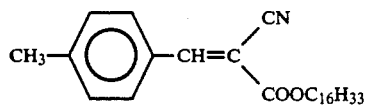
U-2
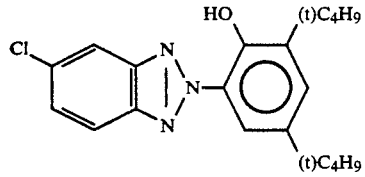
U-3

-continued
U-4
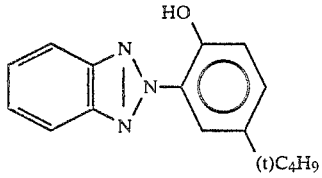
U-5
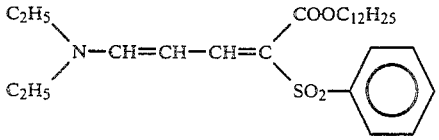
U-6
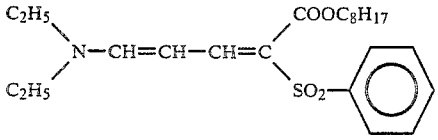
S-1
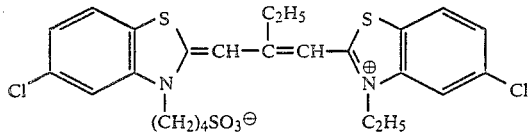
S-2
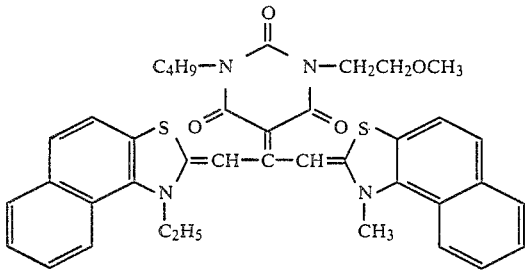
S-3
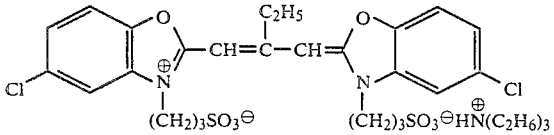
S-4
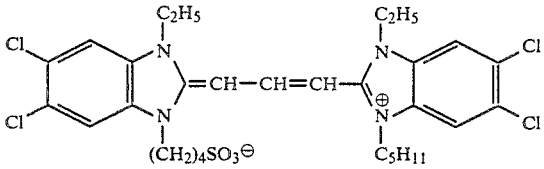
S-5
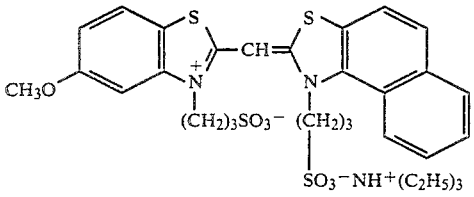
S-6
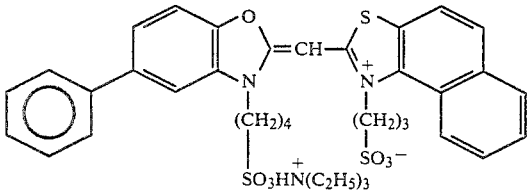

-continued

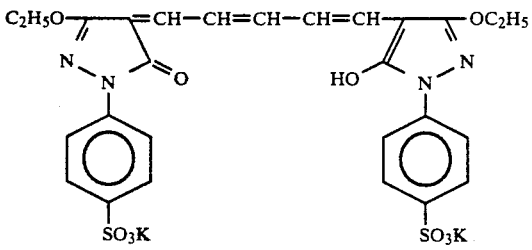

D-1

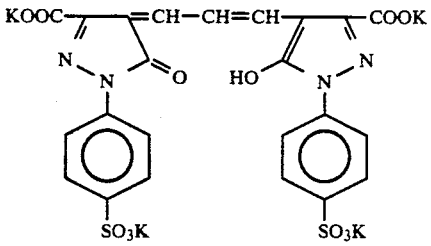

D-2

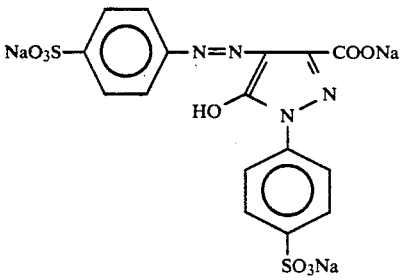

D-3

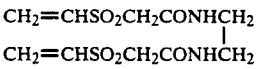

H-1

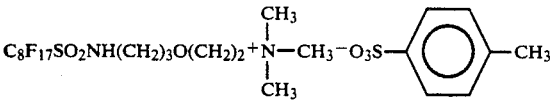

W-1

Other samples Nos. 402 to 408 were prepared in the same manner as above, except that the cyan coupler (C-1) and (C-'3) in all the fourth to sixth layers and/or the magenta couplers (C-4), (C-7) and (C-8) in the ninth to eleventh layers were substituted by the same molar amount of the couplers indicated in Table 4 below.

These samples were exposed through a sensitometrical optical wedge for continuous gradation and then processed in accordance with the processing steps mentioned below. As a result, the samples Nos. 402 to 408 of the present invention gave excellent color images all having an excellent heat-fastness.

TABLE 4

| Sample No. | Cyan Coupler in 4th to 6th Layer | Magenta Coupler in 9th to 11th Layer | Remarks |
|---|---|---|---|
| 401 | C-1, C-3 | C-4, C-7, C-8 | Out of the invention |
| 402 | C-1, C-3 | (8) | Invention |
| 403 | C-1, C-3 | (16) | " |
| 404 | C-1, C-3 | (23) | " |
| 405 | C-1, C-3 | (24) | " |
| 406 | (10) | C-4, C-7, C-8 | " |
| 407 | (25) | C-4, C-7, C-8 | " |
| 408 | (25) | (8) | " |

The processing steps were as follows.

| Processing Steps | Time | Temp. (°C.) | Tank Capacity (liters) | Amount of Replenisher (ml/m$^2$) |
|---|---|---|---|---|
| First Development | 6 min | 38 | 12 | 2200 |
| First Rinsing | 45 sec | 38 | 2 | 2200 |
| Reversal | 45 sec | 38 | 2 | 1100 |
| Color Development | 6 min | 38 | 12 | 2200 |
| Bleaching | 2 min | 38 | 4 | 860 |
| Bleach-fixation | 4 min | 38 | 8 | 1100 |
| Second Rinsing (1) | 1 min | 38 | 2 | — |
| Second Rinsing (2) | 1 min | 38 | 2 | 1100 |
| Stabilization | 1 min | 25 | 2 | 1100 |
| Drying | 1 min | 65 | — | — |

Replenishment in the second rinsing step was effected by a so-called countercurrent replenishment system where the replenisher was introduced into the second rinsing tank (2) and the overflow solution of the second rinsing tank (2) was introduced into the second rinsing tank (1).

The processing solutions used in the above-mentioned processing steps has the following compositions.

| First Developer: | Mother Solution | Replenisher |
|---|---|---|
| Pentasodium Nitrilo-N,N,N-trimethylenephosphonate | 2.0 g | 2.0 g |
| Sodium sulfite | 30 g | 30 g |
| Potassium hydroquinone monosulfonate | 20 g | 20 g |
| Potassium carbonate | 33 g | 33 g |
| 1-Phenyl-4-methyl-4-hydroxymethyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Water to make | 1000 ml | 1000 ml |
| pH | 9.60 | 9.60 |

pH value was adjusted by means of hydrochloric acid or potassium hydroxide.

| Color Developer: | Mother Solution | Replenisher |
|---|---|---|
| Pentasodium nitrilo-N,N,N-trimethylenephosphonate | 2.0 g | 2.0 g |
| Sodium sulfite | 7.0 g | 7.0 g |
| Trisodium phosphate 12-hydride | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N-(β-methanesulfonamidoethyl)-3-methyl-4-aminoaniline sulfate | 11 g | 11 g |
| 3,6-Dithiaoctane-1,8-diol | 1.0 g | 1.0 g |
| Water to make | 1000 ml | 1000 ml |
| pH | 11.80 | 12.00 |

pH value was adjusted by means of hydrochloric acid or potassium hydroxide.

| Bleaching Solution: | Mother Solution | Replenisher (same as mother solution) |
|---|---|---|
| Disodium ethylenediamine tetraacetate dihydrate | 10.0 g | |
| Ammonium ethylenediamine-tetraacetato/Fe(III) dihydrate | 120 g | |
| Ammonium bromide | 100 g | |
| Ammonium nitrate | 10 g | |
| Bleaching accelerator | 0.005 mol | |
| $(CH_3)_2N-CH_2CH_2-S-S-CH_2CH_2-N(CH_3)_2 \cdot 2HCl$ | | |
| Water to make | 1000 ml | |
| pH | 6.30 | |

pH value was adjusted by means of hydrochloric acid or aqueous ammonia.

| First Rinsing Solution: | Mother Solution | Replenisher (same as mother solution) |
|---|---|---|
| Ethylenediaminetetramethylene-phosphonic acid | 2.0 g | |
| Disodium phosphate | 5.0 g | |
| Water to make | 1000 ml | |
| pH | 7.00 | |

pH value was adjusted by means of hydrochloric acid or potassium hydroxide.

| Bleach-Fixing Solution: | Mother Solution | Replenisher (same as mother solution) |
|---|---|---|
| Ammonium ethylenediamine tetraacetato/Fe(III) dihydrate | 50 g | |
| Disodium ethylenediamine tetraacetate dihydrate | 5.0 g | |
| Ammonium thiosulfate | 80 g | |
| Sodium sulfite | 12.0 g | |
| Water to make | 1000 ml | |
| pH | 6.60 | |

pH value was adjusted by means of hydrochloric acid or aqueous ammonia.

| Reversal Solution: | Mother Solution | Replenisher (same as mother solution) |
|---|---|---|
| Pentasodium nitrilo-N,N,N-trimethylenephosphonate | 3.0 g | |
| Stannous chloride dihydrate | 1.0 g | |
| P-aminophenol | 0.1 g | |
| Sodium hydroxide | 8 g | |
| Glacial acetic acid | 15 ml | |
| Water to make | 1000 ml | |
| pH | 6.0 | |

pH value was adjusted by means of hydrochloric acid or sodium hydroxide.

Second Rinsing Solution

Mother solution and replenisher were same.

A city water was passed through a mixed bed column filled with H-type strong acidic cation-exchange resin (Amberlite IR-120B, manufactured by Rhom and Haas Co.) and OH-type anion-exchange resin (Amberlite IR-400, manufactured by Rhom and Haas Co.) thereby to reduce the calcium ion concentration and the magnesium ion concentration each to 3 mg/liter or less, and subsequently, 20 mg/liter of sodium dichloroisocyanurate and 0.15 g/liter of sodium sulfate were added to the resulting water. This gave a pH value of falling within the range of from 6.5 to 7.5.

| Stabilizing Solution: | Mother Solution | Replenisher (same as mother solution) |
|---|---|---|
| Formalin (37%) | 5.0 ml | |
| Polyoxyethylene-p-monononyl-phenyl ether (mean polymerization degree 10) | 0.5 ml | |
| Water to make | 1000 ml | |
| pH | not adjusted | |

EXAMPLE 5

The following first to fourteenth layers were formed on one surface of a polyethylene-laminated (both sides) paper support (thickness: 100 μm) and the following fifteenth and sixteenth layers were formed on the back surface thereof. Accordingly, a multi-layered color photographic material sample (Sample No. 501) was prepared. In the support, the polyethylene in the side of the first layer contained titanium oxide as a white pigment and a slight amount of ultramarine as a bluing dye. The color degree of the surface of the support was 88.0, −0.20, −0.75 in L*, a*, b* system.

Constitution of Light-Sensitive Layers

The constitutive components and the amounts thereof (as unit of g/m$^2$) are described below. The amount of the constitutive silver halide is represented by the amount of silver as coated. The emulsion in each layer was prepared in accordance with the preparation of the emulsion (EM1). The emulsion in the fourteenth layer was a Lippman emulsion, not surface-chemical-sensitized.

| | |
|---|---|
| First Layer: Anti-halation Layer | |
| Black colloidal silver | 0.10 |
| Gelatin | 0.70 |
| Second Layer: Interlayer | |
| Gelatin | 0.70 |
| Third Layer: Low-sensitive Red-sensitive Layer | |
| Silver bromide spectrally sensitized with red-sensitizing dyes (ExS-1,2,3) (mean grain size 0.25 μm; size distribution fluctuation coefficient 8%; octahedral grains) | 0.04 |
| Silver chlorobromide emulsion spectrally sensitized with red-sensitizing dyes (ExS-1,2,3) (silver chloride 5 mol %; mean grain size 0.40 μm; size distribution (fructuation coefficient) 10%; octahedral grains) | 0.08 |
| Gelatin | 1.00 |
| Cyan coupler (ExC-1,2,3 in molar ratio of 1/1/0.2) (all ratios in Examples are shown by molar ratio unless otherwise provided) | 0.30 |
| Anti-fading agent (Cpd-1,2,3,4 of 1/1/1/1) | 0.18 |
| Stain inhibitor (Cpd-5) | 0.003 |
| Coupler dispersing medium (Cpd-6) | 0.03 |
| Coupler solvent (Solv-1,2,3 of 1/1/1) | 0.12 |
| Fourth Layer: High-sensitive Red-sensitive Layer | |
| Silver bromide spectrally sensitized with red-sensitizing dyes (ExS-1,2,3) (mean grain size 0.60 μm; size distribution 15%; octahedral grains) | 0.14 |
| Gelatin | 1.00 |
| Cyan coupler (ExC-1,2,3 of 1/1/0.2) | 0.30 |

-continued

| | |
|---|---|
| Anti-fading agent (Cpd-1,2,3,4 of 1/1/1/1) | 0.13 |
| Coupler dispersing medium (Cpd-6) | 0.03 |
| Coupler solvent (Solv-1,2,3 of 1/1/1) | 0.12 |
| Fifth Layer: Interlayer | |
| Gelatin | 1.00 |
| Anti-fading agent (Cpd-7) | 0.08 |
| Anti-fading agent solvent (Solv-4,5- of 1/1) | 0.16 |
| Polymer latex (Cpd-8) | 0.10 |
| Sixth Layer: Low-sensitive Green-sensitive Layer | |
| Silver bromide spectrally sensitized with green-sensitizing dye (ExS-4) (mean grain size 0.25 μm; size distribution 8%; octahedral grains) | 0.04 |
| Silver chlorobromide spectrally sensitized with green-sensitizing dye (ExS-4) (silver chloride 5 mol %; mean grain size 0.40 μm; size distribution 10%; octahedral grains) | 0.06 |
| Gelatin | 0.80 |
| Magenta coupler (ExM-1,2,3 of 1/1/1) | 0.11 |
| Anti-fading Agent (Cpd-9,26 of 1/1) | 0.15 |
| Stain inhibitor (Cpd-10,11,12,13 of 10/7/7/1) | 0.025 |
| Coupler dispersing medium (Cpd-6) | 0.05 |
| Coupler solvent (Solv-1,6 of 1/1) | 0.15 |
| Seventh Layer: High-sensitive Green-sensitive Layer | |
| Silver bromide as color-sensitized with Green-sensitizing dye (ExS-4) (mean grain size 0.65 μm; size distribution 16%; octahedral grains) | 0.10 |
| Gelatin | 0.80 |
| Magenta coupler (ExM-1,2,3 of 1/1/1) | 0.11 |
| Anti-fading Agent (Cpd-9,26 of 1/1) | 0.15 |
| Stain inhibitor (Cpd-10,11,12,13 of 10/7/7/1) | 0.025 |
| Coupler dispersing medium (Cpd-6) | 0.05 |
| Coupler solvent (Solv-4,6 of 1/1) | 0.15 |
| Eighth Layer: Interlayer | |
| Same as fifth layer | |
| Ninth Layer: Yellow Filter Layer | |
| Yellow colloidal silver | 0.12 |
| Gelatin | 0.07 |
| Anti-fading agent (Cpd-7) | 0.03 |
| Anti-fading agent solvent (Solv-4,5 of 1/1) | 0.10 |
| Polymer latex (Cpd-8) | 0.07 |
| Tenth Layer: Interlayer | |
| Same as fifth layer | |
| Eleventh Layer: Low-sensitive Blue-sensitive Layer | |
| Silver bromide spectrally sensitized with blue-sensitizing dye (ExS-5,6) (mean grain size 0.40 μm; size distribution 8%; octahedral grains) | 0.07 |
| Silver chlorobromide spectrally sensitized with blue-sensitizing dye (ExS-5,6) (silver chloride 8 mol %; mean grain size 0.60 μm; size distribution 11%; octahedral grains) | 0.14 |
| Gelatin | 0.80 |
| Yellow coupler (ExY-1,2 of 1/1) | 0.35 |
| Anti-fading agent (Cpd-14) | 0.10 |
| Stain inhibitor (Cpd-5,15 of 1/5) | 0.007 |
| Coupler dispersing medium (Cpd-6) | 0.05 |
| Coupler solvent (Solv-2) | 0.10 |
| Twelfth Layer: High-sensitive Blue-sensitive Layer | |
| Silver bromide spectrally sensitized with blue-sensitizing dye (ExS-5,6) (mean grain size 0.85 μm; size distribution 18%; octahedral grains) | 0.15 |
| Gelatin | 0.60 |
| Yellow coupler (ExY-1,2 of 1/1) | 0.30 |
| Anti-fading agent (Cpd-14) | 0.10 |

-continued

| | |
|---|---|
| Stain inhibitor (Cpd-5,15 of 1/5) | 0.007 |
| Coupler dispersing medium (Cpd-6) | 0.05 |
| Coupler solvent (Solv-2) | 0.10 |
| Thirteenth Layer: Ultraviolet Absorbing Layer | |
| Gelatin | 1.00 |
| Ultraviolet absorbent (Cpd-2,4,16 of 1/1/1) | 0.50 |
| Color mixing preventing agent Cpd-7,17 of 1/1) | 0.03 |
| Dispersing medium (Cpd-6) | 0.02 |
| Ultraviolet absorbent solvent (Solv-2,7 of 1/1) | 0.08 |
| Anti-irradiation dye (Cpd-18,19,20,21,27 of 10/10/13/15/20) | 0.05 |
| Fourteenth Layer: Protective Layer | |
| Fine silver chlorobromide grains (silver chloride 97 mol %; mean grain size 0.1 μm) | 0.03 |
| Acryl-modified copolymer of polyvinyl alcohol | 0.01 |
| Polymethyl methacrylate grains (mean grain size 2.4 μm) and silicon oxide(mean grain size 5 μm) of 1/1 mixture | 0.05 |
| Gelatin | 1.80 |
| Gelatin hardening agent (H-1,H-2 of 1/1) | 0.18 |
| Fifteenth Layer: Backing Layer | |
| Gelatin | 2.50 |
| Ultraviolet absorbent (Cpd-2,4,16 of 1/1/1) | 0.50 |
| Dye (Cpd-18,19,20,21,27 of 1/1/1/1/1) | 0.06 |
| Sixteenth Layer: Backing Protecting Layer | |
| Polymethyl methacrylate grains (mean grain size 2.4 μm) and silicon oxide (mean grain size 5 μm) of 1/1 mixture | 0.05. |
| Gelatin | 2.00 |
| Gelatin hardening agent (H-1,H-2 of 1/1) | 0.14 |

Preparation of Emulsion EM-1

An aqueous solution containing potassium bromide and an aqueous solution containing silver nitrate were simultaneously added to an aqueous gelatin solution with vigorously stirring at 75° C. over a period of 15 minutes to form octahedral silver bromide grains having a mean grain size of 0.40 μm. To the emulsion were added 0.3 g per mol of silver of 3,4-dimethyl-1,3-thiazoline-2-thione, 6 mg per mol of silver of sodium thiosulfate and 7 mg per mol of silver of chloroauric acid (tetrahydrate) in order, and thereafter the whole was heated up to 75° C. for 80 minutes for chemical sensitization. The core grains thus formed were then grown further under the same precipitation condition as the first step, and finally a monodispersed emulsion containing octahedral core/shell silver bromide grains having a mean grain size of 0.7 μm was obtained. The fluctuation coefficient of the grain size of the grains was about 10%.

To the emulsion were added 1.5 mg per mol of silver of sodium thiosulfate and 1.5 mg per mol of silver of chloroauric acid (tetrahydrate), and the whole was then heated at 60° C. for 60 minutes for chemical sensitization. Accordingly, an internal latent image type silver halide emulsion was obtained.

Each of the above-mentioned light-sensitive layers contained ExZK-1 and ExZK-2 in an amount of $1\times10^{-3}$% by weight and $10^{-2}$% by weight, respectively, based on the weight of silver halide as nucleating agents and Cpd-22 in the amount of $1\times10^{-2}$% by weight based on the weight of silver halide as a nucleation accelerator. Additionally, the respective layers contained Alkanol XC (manufactured by DuPont) and sodium alkylbenzenesulfonate as emulsification and dispersion aids and succinic acid ester and Magefax F-120 (manufactured by Dai-Nippon Ink) as coating aids. The layers containing silver halide and colloidal silver contained a stabilizer (Cpd-23,24,25). The sample thus prepared was called Sample No. 501. The compounds used for preparing the same are mentioned below.

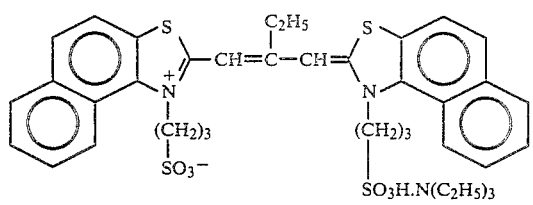

ExS-1

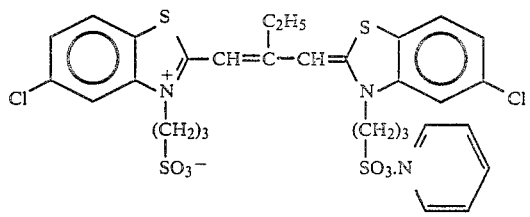

ExS-2

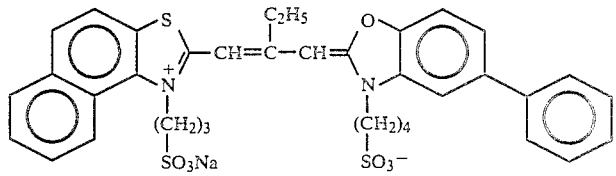

ExS-3

-continued
ExS-4
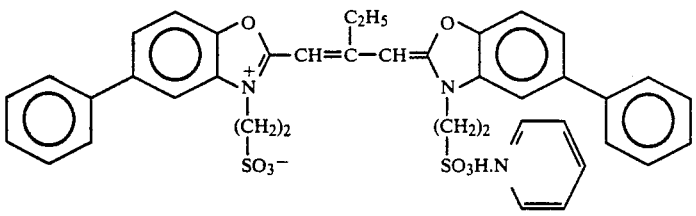
ExS-5
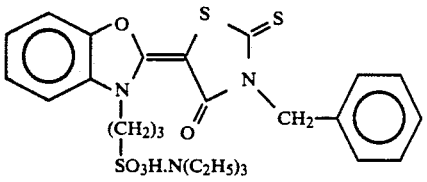
ExS-6
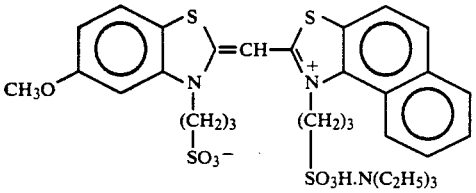
Cpd-1
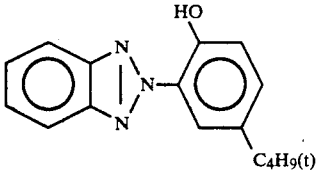
Cpd-2
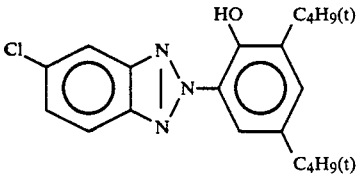
Cpd-3
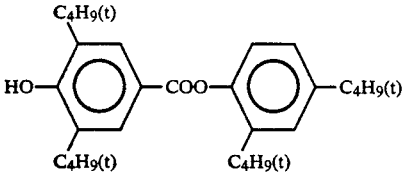
Cpd-4
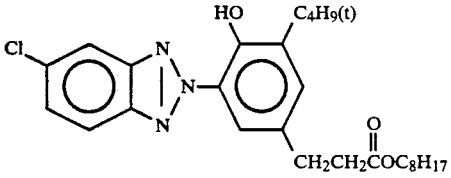
Cpd-5
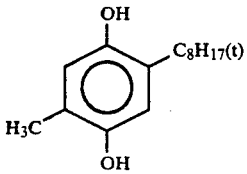
Cpd-6
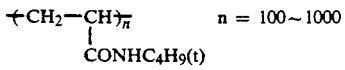

-continued
Cpd-7
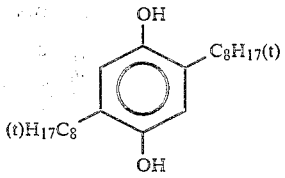
Cpd-8
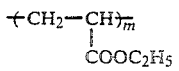
(molecular weight: 40,000)
Cpd-9
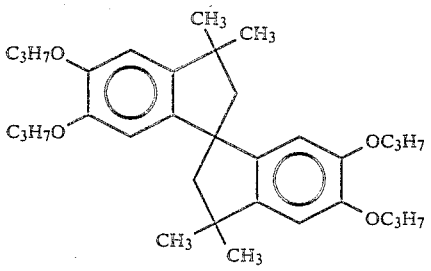
Cpd-10
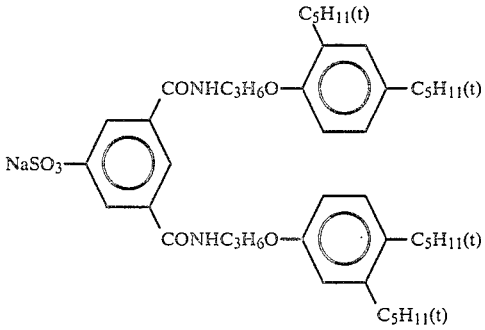
Cpd-11
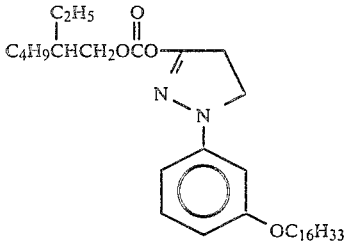
Cpd-12
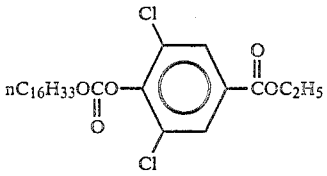
Cpd-13
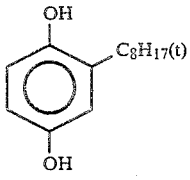
Cpd-14
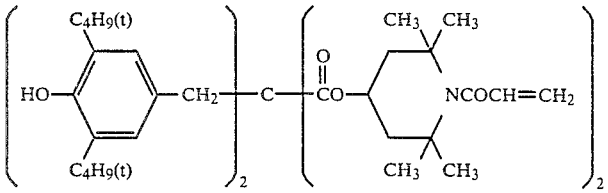

-continued
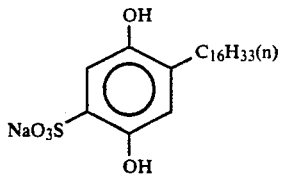
Cpd-15
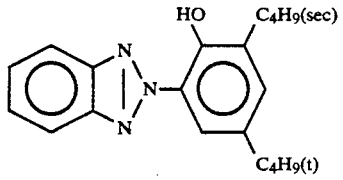
Cpd-16
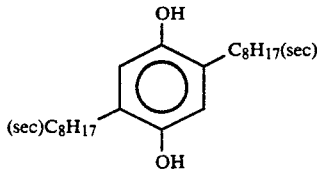
Cpd-17
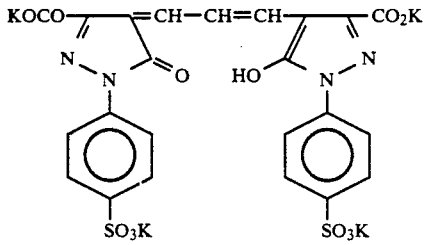
Cpd-18
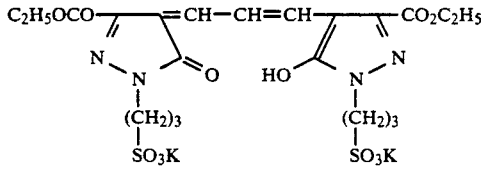
Cpd-19
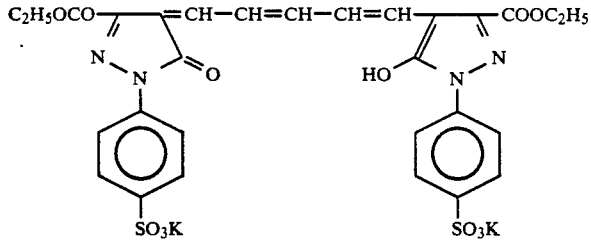
Cpd-20
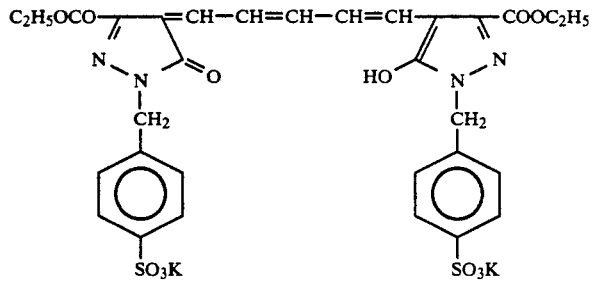
Cpd-21
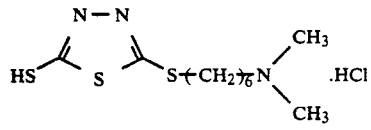
Cpd-22

-continued
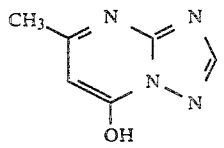
Cpd-23
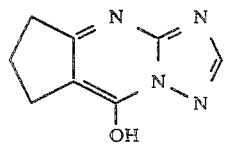
Cpd-24
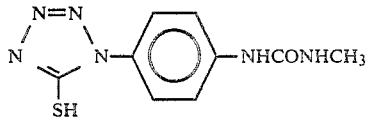
Cpd-25
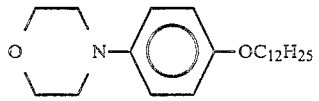
Cpd-26
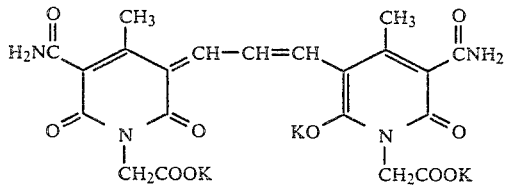
Cpd-27
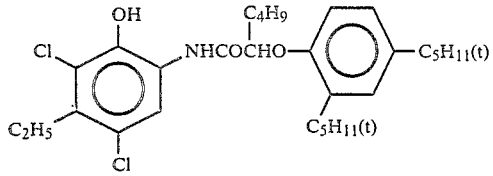
ExC-1
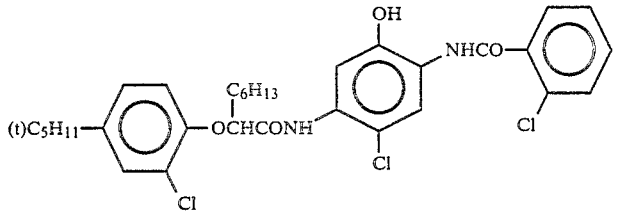
EXC-2
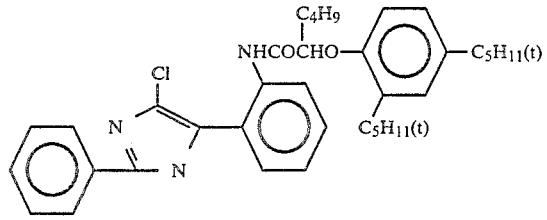
EXC-3

-continued

EXM-1

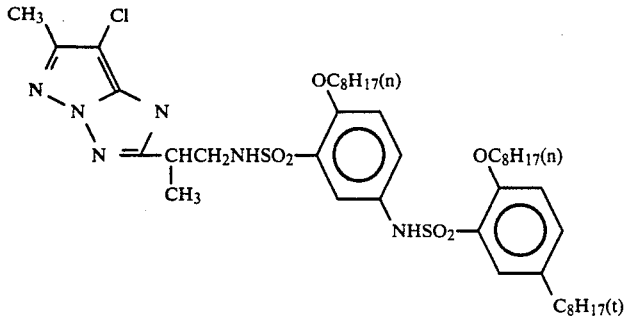

EXM-2

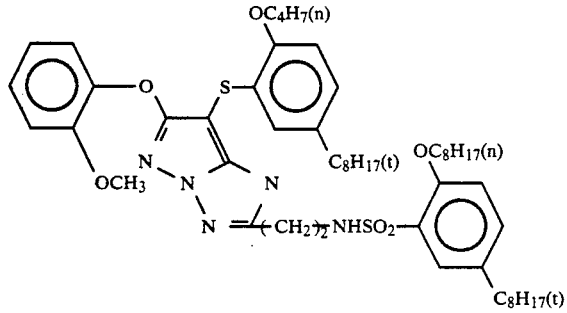

EXM-3

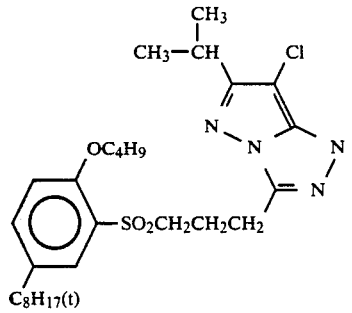

EXY-1

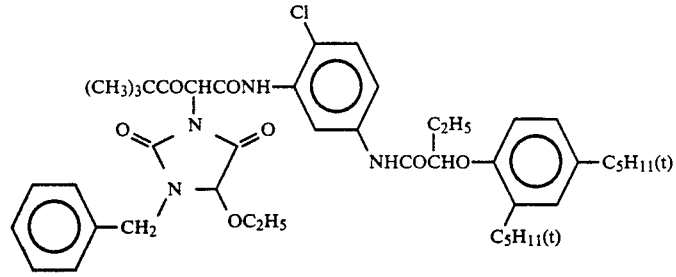

ExY-2:

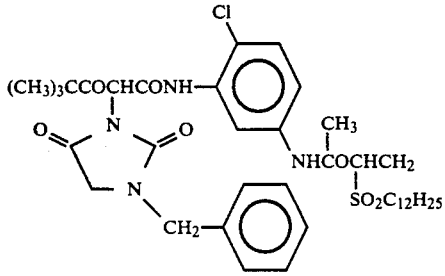

Solv-1: Di(2-ethylhexyl) Sebacate
Solv-2: Trinonyl phosphate
Solv-3: Di(3-methylhexyl) phthalate
Solv-4: Tricresyl phosphate
Solv-5: Dibutyl phthalate
Solv-6: Trioctyl phosphate
Solv-7: Di(2-ethylhexyl) phthalate
H-1: 1,2-Bis(vinylsulfonylacetamido)ethane
H-2: 4,6-Dichloro-2-hydroxy-1,3,5-triazine sodium salt
ExZK-1: 7-(3-Ethoxythiocarbonylaminobenzamido)-9-methyl-10-propargyl-1,2,3,4-tetrahydroacrydinium trifluoromethanesulfonate
ExZK-2: 2-(4-(3-(3-(3-(5-(3-(2-Chloro-5-(1-dodecyloxycarbonylethoxycarbonyl)phenylcarbamoyl)-4-hydroxy-1-naphthylthio}tetrazol-1-yl)phenyl-)ureido)benzenesulfonamido)phenyl)-1-formylhydrazine Other samples Nos. 502 to 506 were prepared in the same manner as above, except that the cyan coupler ExC-1, ExC-2 and ExC-3 in the third and fourth layers and the magenta coupler ExM-1, ExM-2 and ExM-3 in the sixth and seventh layers were substituted by the same molar amount of the total amount of each cyan and magenta couplers as indicated in Table 5 below.

These samples were exposed through a sensitometrical optical wedge for continuous gradation and then processed in accordance with the processing steps mentioned below. As a result, the samples 502 to 506 of the present invention gave excellent color images all having an excellent heat-fastness.

TABLE 5

| Sample No. | Cyan Coupler in 3rd and 4th Layers | Magenta Coupler in 6th and 7th Layers | Remarks |
|---|---|---|---|
| 501 | ExC-1, ExC-2 and ExC-3 | ExC-1, ExC-2 and ExC-3 | Out of the invention |
| 502 | ExC-1, ExC-2 and ExC-3 | (14) | Invention |
| 503 | ExC-1, ExC-2 and ExC-3 | (16) | " |
| 504 | ExC-1, ExC-2 and ExC-3 | (24) | " |
| 505 | (10) | (14) | " |
| 506 | (25) | (24) | " |

The processing steps were as follows.

| Processing Steps | Time (sec) | Temp. (°C.) | Mother Solution Tank Capacity (liters) | Amount of Replenisher (mg/m²) |
|---|---|---|---|---|
| Color Development | 135 | 38 | 15 | 300 |
| Bleach-fixation | 40 | 33 | 3 | 300 |
| Rinsing (1) | 40 | 33 | 3 | — |
| Rinsing (2) | 40 | 33 | 3 | 320 |
| Drying | 30 | 80 | | |

Rinsing was effected by a so-called counter-current replenishment system where the replenisher was supplied to the rinsing bath (2) and the overflow of the rinsing bath (2) was introduced into the rinsing bath (1). The amount of the carryover of the bleach-fixing solution from the bleach-fixing bath to the rinsing bath (1) was 35 ml/m² and the magnification of the rinsing replenisher to the carryover of the bleach-fixing solution was 9.1 times.

The processing solutions used in the respective processing steps were as follows:

Color Developer:

| | Mother Solution (g) | Replenisher (g) |
|---|---|---|
| Ethylenediamine-tetrakis-methylenephosphonic acid | 1.5 g | 1.5 g |
| Diethylene glycol | 10 ml | 10 ml |
| Benzyl alcohol | 12.0 ml | 14.4 ml |
| Potassium bromide | 0.70 g | — |
| Benzotriazole | 0.003 g | 0.004 g |
| Sodium sulfite | 2.4 g | 2.9 g |
| Glucose | 2.5 g | 3.0 g |
| N,N-bis(carboxymethyl)hydrazine | 4.0 g | 4.8 g |
| Triethanolamine | 6.0 g | 7.2 g |
| N-ethyl-N-(β-methanesulfonamido-ethyl)-3-methyl-4-aminoaniline sulfate | 6.0 g | 7.2 g |
| Potassium carbonate | 30.0 g | 25.0 g |
| Brightening agent (diaminostilbene compound) | 1.0 g | 1.2 g |
| Water to make | 1000 ml | 1000 ml |
| pH (25° C.) | 10.25 | 10.80 |

Bleach-fixing Solution:

-continued

| | Mother Solution | Replenisher (same as mother solution) |
|---|---|---|
| Disodium ethylenediamine-tetraacetate dihydrate | 4.0 g | |
| Ammonium ethylenediamine-tetraacetato/Fe(III) dihydrate | 70.0 g | |
| Ammonium thiosulfate (700 g/liter) | 180 ml | |
| Sodium P-toluenesulfinate | 20.0 g | |
| Sodium bisulfite | 20.0 g | |
| 5-Mercapto-1,3,4-triazole | 0.5 g | |
| Ammonium nitrate | 10.0 g | |
| Water to make | 1000 ml | |
| pH (25° C.) | 6.20 | |

Rinsing Solution

Mother solution and replenisher were same.

A city water was passed through a mixed bed column filled with H-type strong acidic cation-exchange resin (Amberlite IR-120B, manufactured by Rhom and Haas Co.) and OH-type anion-exchange resin (Amberlite IR-400, manufactured by Rhom and Haas Co.) thereby to reduce the calcium ion concentration and the magnesium ion concentration each to 3 mg/liter or less, and subsequently, 20 mg/liter of sodium dichloroisocyanurate and 0.15 g/liter of sodium sulfate were added to the resulting water. This gave pH value of falling within the range of from 6.5 to 7.5.

As explained in detail in the above, the present invention provides novel couplers which are prepared easily and inexpensively, and the couplers give color images having an excellent color-fastness.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having photographic constitutive layers comprising at least one silver halide emulsion layer on a support, wherein at least one layer of the photographic constitutive layers contains at least one color-forming aminopyrimidine coupler of formula (I):

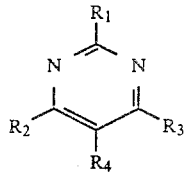

(I)

wherein $R_1$, $R_2$, and $R_3$ independently represent a hydrogen atom, a halogen atom, an alkoxy group, an aryloxy group, a heterocyclic-oxy group, an alkylthio group, an arylthio group, a heterocyclic-thio group, a substituted or unsubstituted amino group, a heterocyclic group bonding to the pyrimidine ring via a nitrogen atom thereof, an alkyl group or an aryl group; provided that at least one of $R_1$, $R_2$ and $R_3$ is an unsubstituted or substituted amino group, and that when any one of $R_1$, $R_2$ or $R_3$ contains a sulfonic acid group or a salt thereof, $R_1$, $R_2$ or $R_3$ contains at least one linear or branched alkyl group and that the total carbon atoms in the alkyl group(s) are to be more than 8; and $R_4$ represents a hydrogen atom, a halogen atom, an alkoxy group, an aryloxy group, a heterocyclic-oxy group, an alkylthio group, an arylthio group, a heterocyclic-thio group, a substituted or unsubstituted amino group, or a heterocyclic group bonding to the pyrimidine ring via a nitrogen atom thereof.

2. The silver halide color photographic material as in claim 1, wherein the coupler of formula (I) is incorporated into at least one of a light-sensitive silver halide emulsion layer(s), a light-insensitive silver halide emulsion layer(s) and an interlayer(s).

3. The silver halide color photographic material as in claim 1, wherein the amount of the coupler is from $1\times10^{-5}$ to $1\times10^{-2}$ mol/m$^2$.

4. The silver halide color photographic material as in claim 1, wherein the heterocyclic ring in the heterocyclic ring-containing group is a 5- to 7-membered ring containing at least one of N, O and S atoms as a hetero atom, and said ring may be a condensed ring.

5. The silver halide color photographic material as in claim 1, wherein the substituent of the monosubstituted amino group is a group selected from the group consisting of an alkyl group, an aryl group and a heterocyclic group.

6. The silver halide color photographic material as in claim 1, wherein at least one of $R_1$, $R_2$, $R_3$ and $R_4$ contains at least one of alkyl group, an aryl group, and a heterocyclic group each substituted with at least one group selected from the group consisting of a halogen atom, a nitro group, a cyano group, a carboxyl group, a sulfonic acid group, an alkyl group, an aryl group, an alkoxy group, an aryloxy group, an alkylthio group, an arylthio group, an amino group, a carbonamido group, a sulfonamido group, a carbamoyl group, a sulfamoyl group, an acyl group, an acyloxy group, an alkoxycarbonyl group, an aryloxycarbonyl group, a heterocyclic group, an alkoxysulfonyl group, an aryloxysulfonyl group, an ureido group, an alkoxycarbonylamino group, an aryloxycarbonylamino group, a sulfamoylamino group, an alkylsulfonyl group and an arylsulfonyl group.

7. The silver halide color photographic material as in claim 1, wherein the coupler is represented by formula (II):

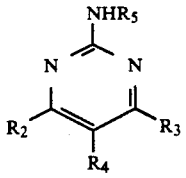

(II)

wherein $R_2$, $R_3$ and $R_4$ have the same meanings as defined in claim 1; and $R_5$ represents a hydrogen atom, an alkyl group, an aryl group or a heterocyclic group.

8. The silver halide color photographic material as in claim 1, wherein the coupler is represented by formula (III):

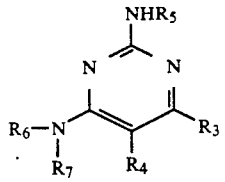

(III)

wherein $R_3$ and $R_4$ have the same meanings as defined in claim 1; $R_5$ represents a hydrogen atom, an alkyl group, an aryl group or a heterocyclic group; and $R_6$ and $R_7$ independently represent a hydrogen atom, an alkyl group, an aryl group or a heterocyclic group, or $R_6$ and $R_7$ may be combined to form a heterocyclic ring.

9. The silver halide color photographic material as in claim 1, wherein $R_1$, $R_2$ and $R_3$ each represents a hydrogen atom, a halogen atom, a substituted or unsubstituted amino group, an aryloxy group, an arylthio group, or an alkylthio group.

10. The silver halide color photographic material as in claim 1, wherein $R_1$, $R_2$ and $R_3$ each represents a substituted or unsubstituted amino group selected from the group consisting of an amino group, a monoalkylamino group, a dialkylamino group, a monoarylamino group and a diarylamino group.

11. The silver halide color photographic material as in claim 7, wherein $R_5$ represents an aryl group.

12. The silver halide color photographic material as in claim 8, wherein $R_6$ is a hydrogen atom and $R_7$ represents an aryl group.

13. The silver halide color photographic material as in claim 7, wherein $R_3$ represents a hydrogen atom, a halogen atom, an aryloxy group, an arylthio group, an alkylthio group, a substituted or unsubstituted amino group.

14. The silver halide color photographic material as in claim 8, wherein $R_3$ represents a hydrogen atom, a halogen atom, an aryloxy group, an arylthio group, an alkylthio group, a substituted or unsubstituted amino group.

15. The silver halide color photographic material as in claim 7, wherein $R_3$ represents

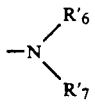

wherein $R'_6$ and $R'_7$ independently represent a halogen atom, an alkyl group, an aryl group or a heterocyclic group, or $R'_6$ and $R'_7$ may be combined to form a heterocyclic ring.

16. The silver halide color photographic material as in claim 8, wherein $R_3$ represents

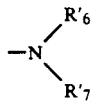

wherein $R'_6$ and $R'_7$ independently represent a halogen atom, an alkyl group, an aryl group or a hetercyclic group, or $R'_6$ and $R'_7$ may be combined to from a heterocyclic ring.

* * * * *